US007465866B2

(12) United States Patent
Ueki et al.

(10) Patent No.: US 7,465,866 B2
(45) Date of Patent: Dec. 16, 2008

(54) ASSISTIVE APPARATUS AND COMPUTER-READABLE MEDIUM STORING COMPUTER PROGRAM FOR PLAYING MUSIC

(75) Inventors: Kazuhisa Ueki, Shizuoka-ken (JP); Tadahiko Ikeya, Shizuoka-ken (JP); Masao Ishibashi, Shizuoka-ken (JP); Shinichi Ito, Shizuoka-ken (JP); Sachiyo Kubo, Tokyo (JP); Masaki Hara, Tokyo (JP); Tetsuya Takagi, Tokyo (JP)

(73) Assignees: Yamaha Corporation (JP); Yamaha Music Foundation (JP)

( * ) Notice: Subject to any disclaimer, the term of this patent is extended or adjusted under 35 U.S.C. 154(b) by 0 days.

(21) Appl. No.: 11/865,066

(22) Filed: Sep. 30, 2007

(65) Prior Publication Data

US 2008/0028919 A1 Feb. 7, 2008

Related U.S. Application Data

(63) Continuation of application No. 10/655,491, filed on Sep. 4, 2003, now Pat. No. 7,297,859.

(30) Foreign Application Priority Data

| | | |
|---|---|---|
| Sep. 4, 2002 | (JP) | 2002-258917 |
| Dec. 5, 2002 | (JP) | 2002-354134 |
| Dec. 5, 2002 | (JP) | 2002-354135 |
| Dec. 13, 2002 | (JP) | 2002-361884 |

(51) Int. Cl.
*G10H 1/38* (2006.01)

(52) U.S. Cl. ..... 84/613; 84/600

(58) Field of Classification Search ..... 84/613, 84/600, 609

See application file for complete search history.

(56) References Cited

U.S. PATENT DOCUMENTS

| | | | | |
|---|---|---|---|---|
| 5,315,060 | A * | 5/1994 | Paroutaud | 84/726 |
| 5,403,967 | A | 4/1995 | Takano | |
| 5,612,501 | A * | 3/1997 | Kondo et al. | 84/637 |
| 5,850,051 | A * | 12/1998 | Machover et al. | 84/634 |
| 6,100,462 | A * | 8/2000 | Aoki | 84/613 |
| 6,639,141 | B2 * | 10/2003 | Kay | 84/609 |

FOREIGN PATENT DOCUMENTS

JP 2001-100745 A 4/2001

OTHER PUBLICATIONS

Relevant portion of Japanese Office Action for corresponding Japanese Patent Application No. 2003-312111, dated Sep. 26, 2006.

* cited by examiner

*Primary Examiner*—Walter Benson
*Assistant Examiner*—Jianchun Qin
(74) *Attorney, Agent, or Firm*—Rossi, Kimms & McDowell LLP

(57) ABSTRACT

An assistive music playing apparatus plays a music piece with musically acceptable notes even when the player inputs musically unacceptable notes. The apparatus provides a chord progression pattern, and comprises a note conversion device. A chord progression pattern defines a series of chords, which are presented one after another in time for a music progression. As the player plays music, inputting potentially unacceptable notes, the inputted notes will be converted to musically acceptable notes with reference to the currently presented chord in the chord progression. The note conversion rules are prepared different for a melody note range, a chord note range and a bass note range. Overlap of converted notes are avoided. Depending on the conditions of the player's note input, i.e., whether the melody is ascending or descending, or the chord is played in a block chord or in an arpeggio, the conversion rules may be selected to generate notes which fit the designated chord, even including non-basic notes or tension notes.

24 Claims, 21 Drawing Sheets

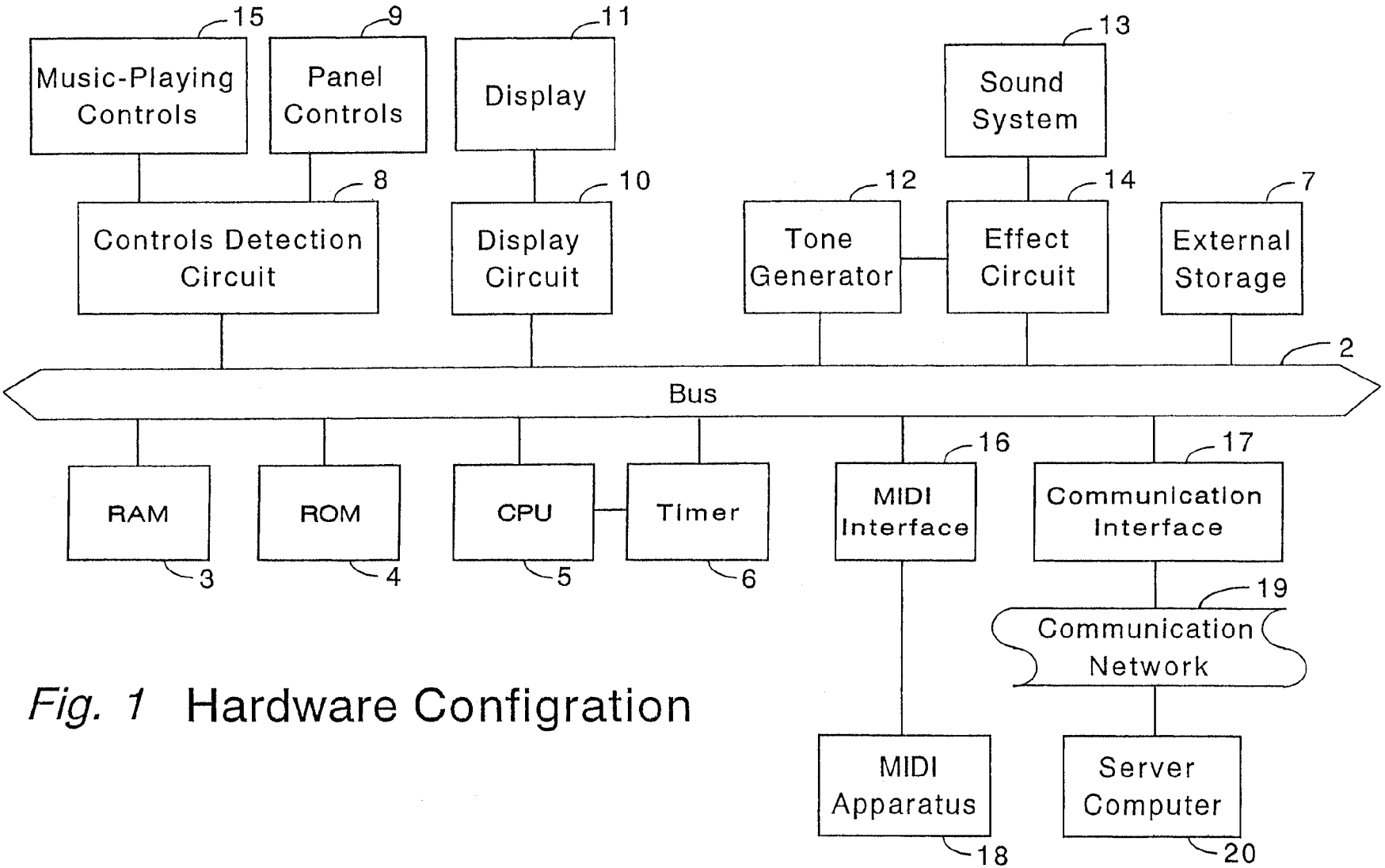
*Fig. 1* Hardware Configration

*Fig. 2* Function Block Configration
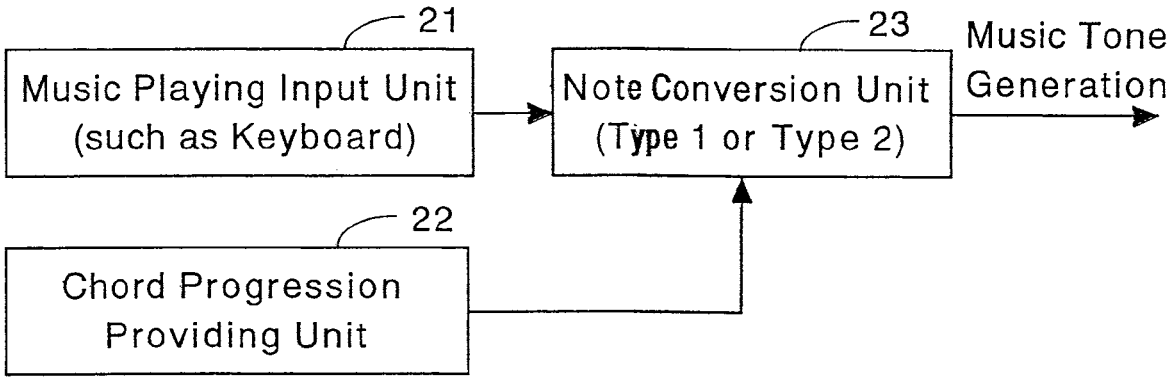

Music Playing Assist Processing #1

*Fig. 3b* User-Set Parameters
| User Setting |
| --- |
| 〈Key Designation〉 |
| F Major |
| 〈Chord Progression〉 |
| \| I \| V \| II \| VI \| - - |
| 〈Table for Chord Tone Distribution〉 |
| Normal |
*Fig. 3c* Note Inputs
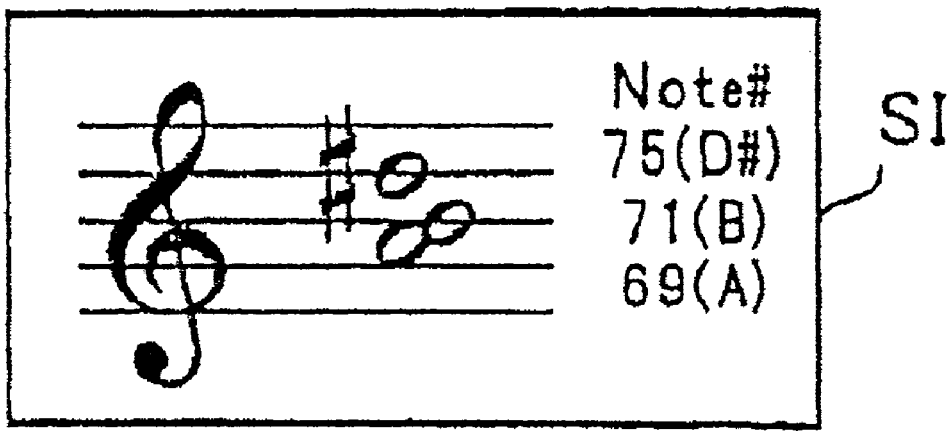

*Fig. 3d* Table for Chord Tone Distribution
| Normal | | | |
|---|---|---|---|
| Note# \ Degree | Ⅳ | Ⅴ | Ⅵ |
| 75(D#) | 2 | −1 | 1 |
| 76(E) | 1 | −2 | 0 |
| 77(F) | 0 | 2 | −1 |
| 78(F#) | −1 | 1 | −2 |
| 79(G) | −2 | 0 | 2 |
| 80(G#) | 1 | −1 | 1 |
| 81(A) | 0 | −2 | 0 |
| 82(A#) | 2 | 1 | −1 |
CDT
*Fig. 3e* Note Outputs
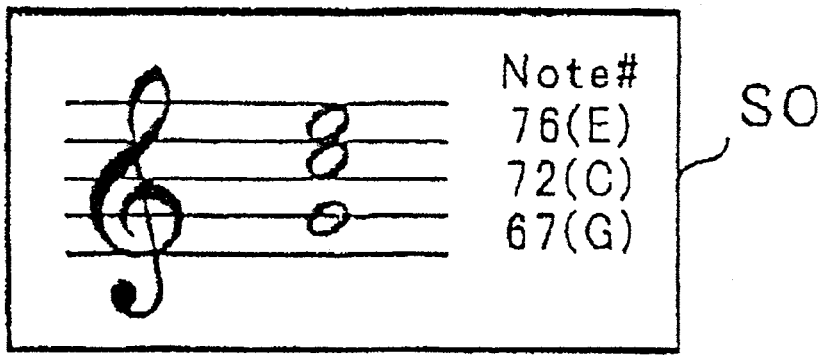

Music Playing Assist Processing #2

*Fig. 4b*

Table for Tone Numbers to be Generated

| Number-OfNotes | Range | Tone Numbers to Be Generated |
|---|---|---|
| 1 | - | 1 |
| 2 | Less than 1 Octave | 1, 2 |
| | 1 Octave or More | 1, 4 |
| 3 | Less than 1 Octave | 1, 2, 3 |
| | 1 Octave or More | 1, 2, 4 |
| 4 or more | - | 1, 2, 3, 4 |

TNT

*Fig. 4c* Table for Chord Notes

| Normal | | ChordDegree=V | | |
|---|---|---|---|---|
| GTN / TND | 1 | 2 | 3 | 4 |
| 0 | −1 | −10 | −5 | −29 |
| 1 | 1 | −2 | −6 | −18 |
| 2 | 0 | −3 | −7 | −19 |
| 3 | −1 | −4 | −8 | −20 |
| 4 | 0 | −5 | −9 | −21 |
| 5 | 0 | −6 | −3 | −22 |
| 6 | −1 | −7 | −4 | −23 |
| 7 | 0 | −8 | −5 | −24 |
| 8 | −1 | −9 | −6 | −25 |
| 9 | 0 | −10 | −7 | −26 |
| 10 | 1 | −8 | −3 | −27 |
| 11 | 0 | −9 | −4 | −28 |

CNT

*Fig. 5a* Note Conversion Range
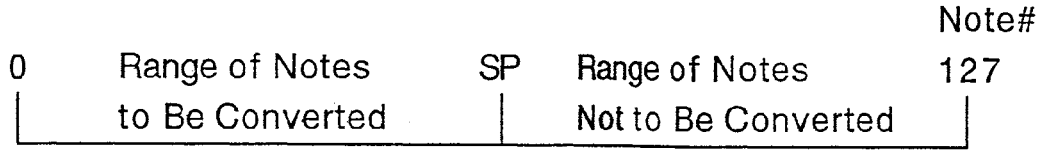
*Fig. 5b* Function Block Configration
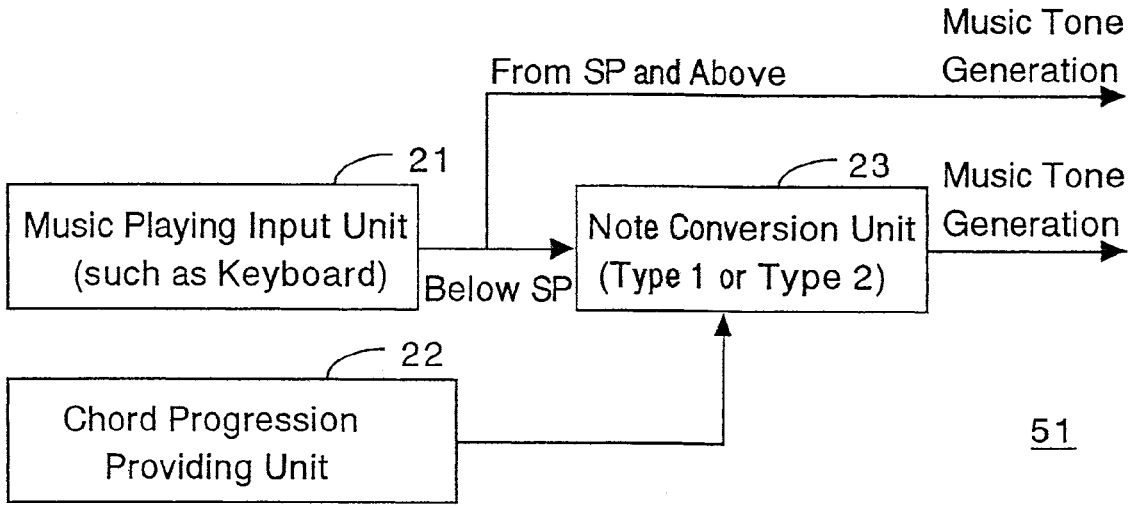

*Fig. 6a* Note Conversion Range
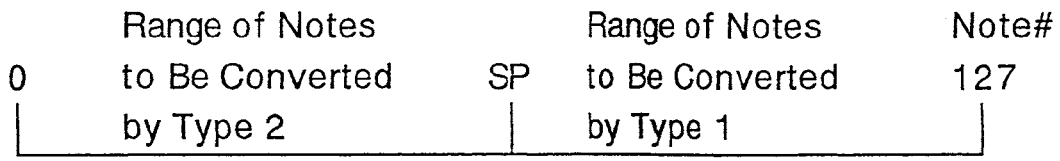
*Fig. 6b* Function Block Configration
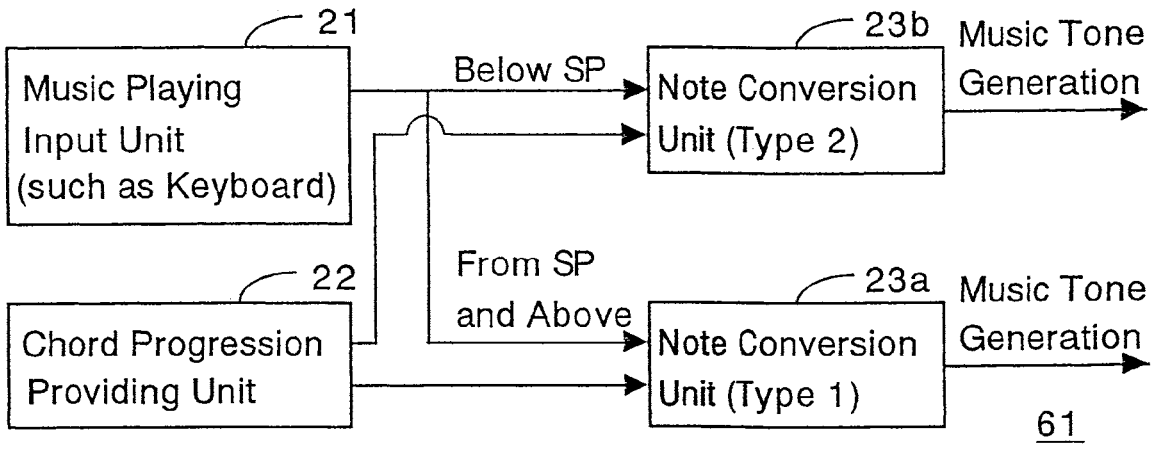

*Fig. 7* Function Block Configration
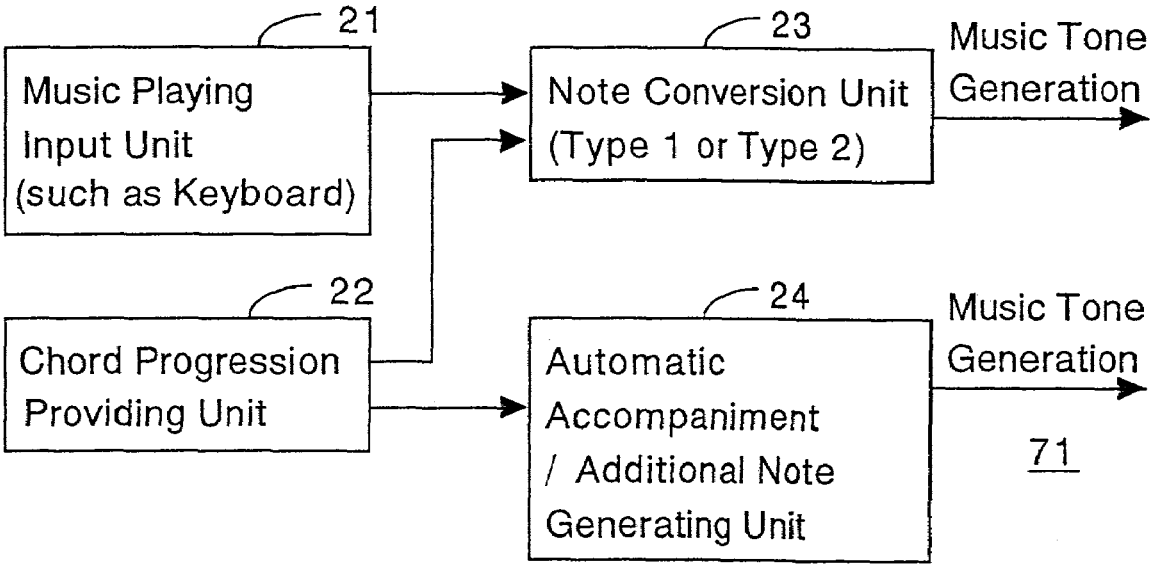

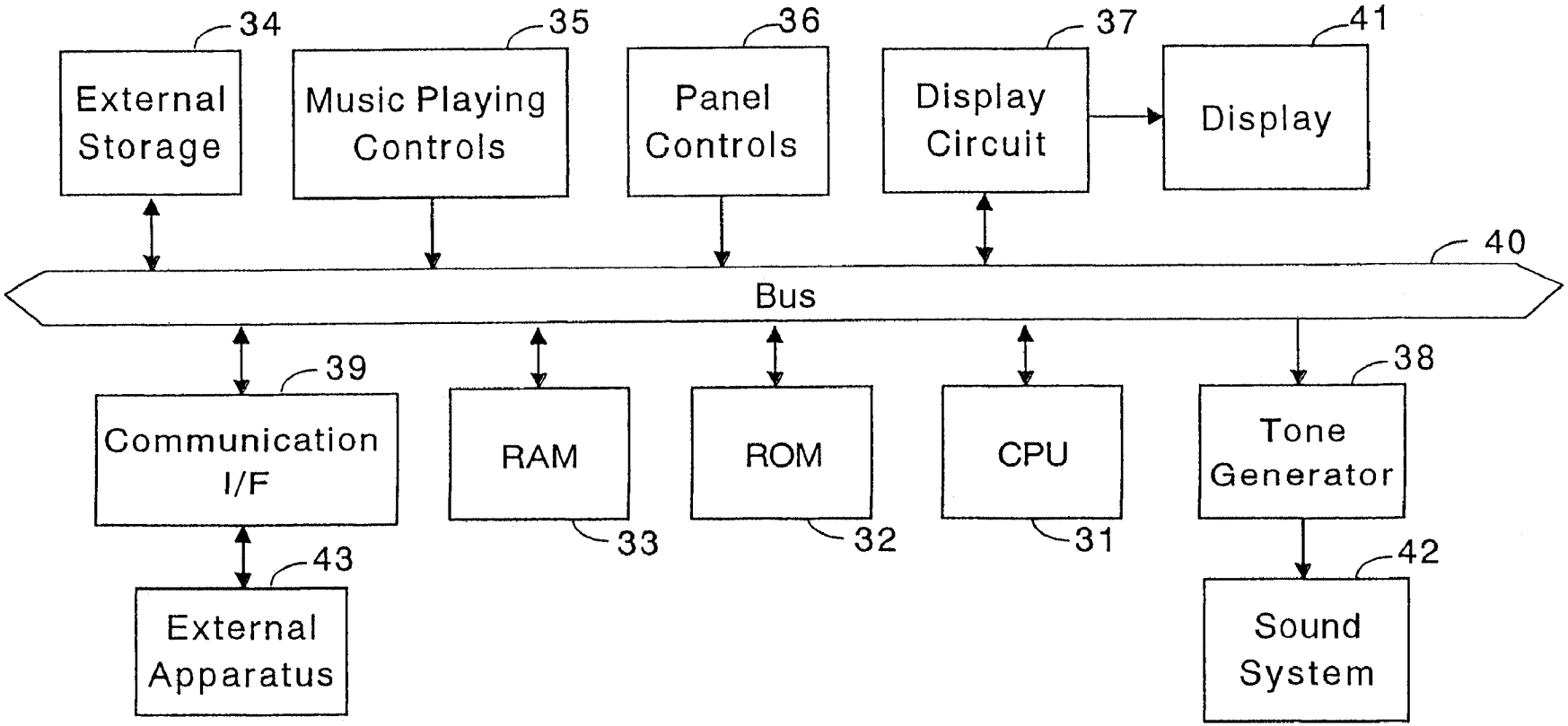
*Fig. 8* Hardware Configration

*Fig. 9* Modul Configration
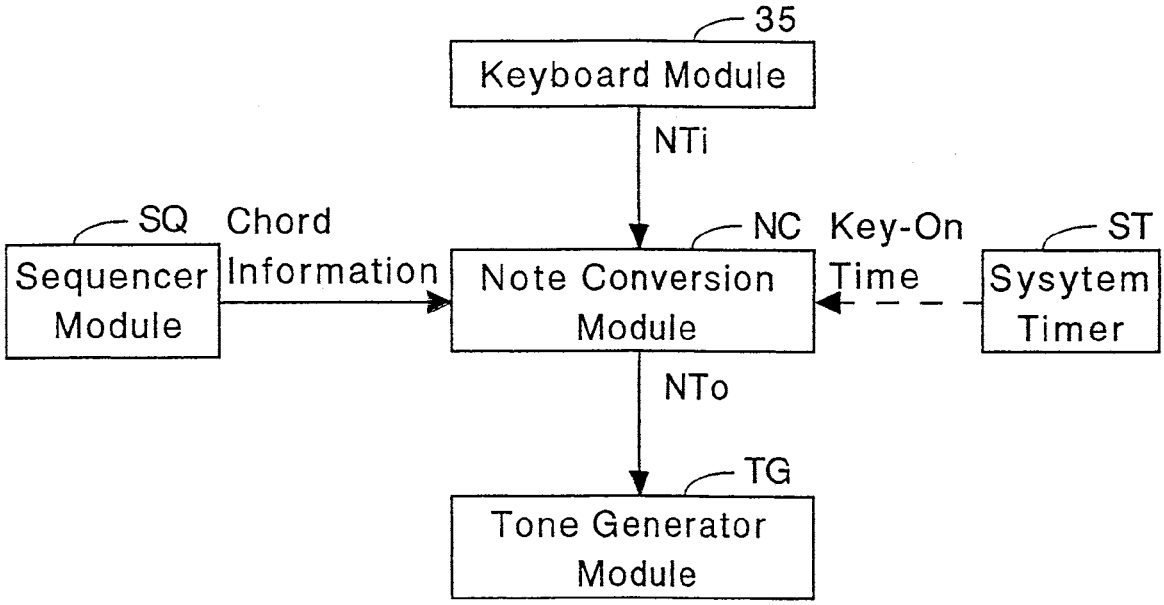

*Fig. 10* Note Conversion Table TB

| Chord Type | Distance from Root (in Semitones) | | | | | | | | | | | |
|---|---|---|---|---|---|---|---|---|---|---|---|---|
| | 0 | 1 | 2 | 3 | 4 | 5 | 6 | 7 | 8 | 9 | 10 | 11 |
| | Note Names for Root of C | | | | | | | | | | | |
| | C | C# | D | E♭ | E | F | F# | G | A♭ | A | B♭ | B |
| Major | 3 | 0 | 0 | 0 | 1 | 0 | 0 | 2 | 0 | 0 | 0 | 0 |
| M7 | 4 | 0 | 0 | 0 | 2 | 0 | 0 | 3 | 0 | 0 | 0 | 1 |
| M6 | 4 | 0 | 0 | 0 | 2 | 0 | 0 | 3 | 0 | 1 | 0 | 0 |
| ⋮ | | | | | | | ⋮ | | | | | |
| Cancel(※) | 1 | 1 | 1 | 1 | 1 | 1 | 1 | 1 | 1 | 1 | 1 | 1 |

*Fig. 11* Key-On Event Processing (Part1)
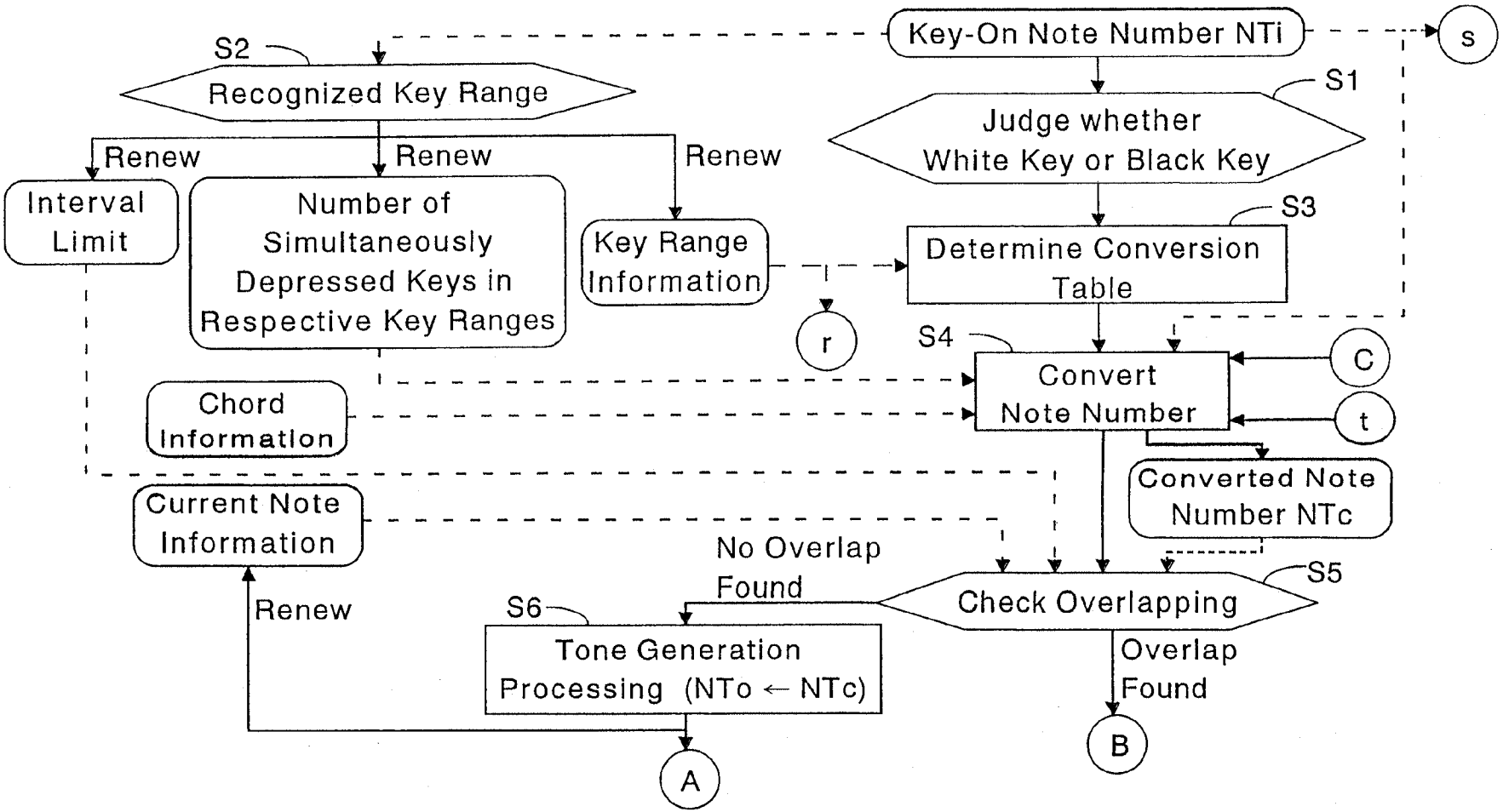

Fig. 12 Key-On Event Processing (Part2)
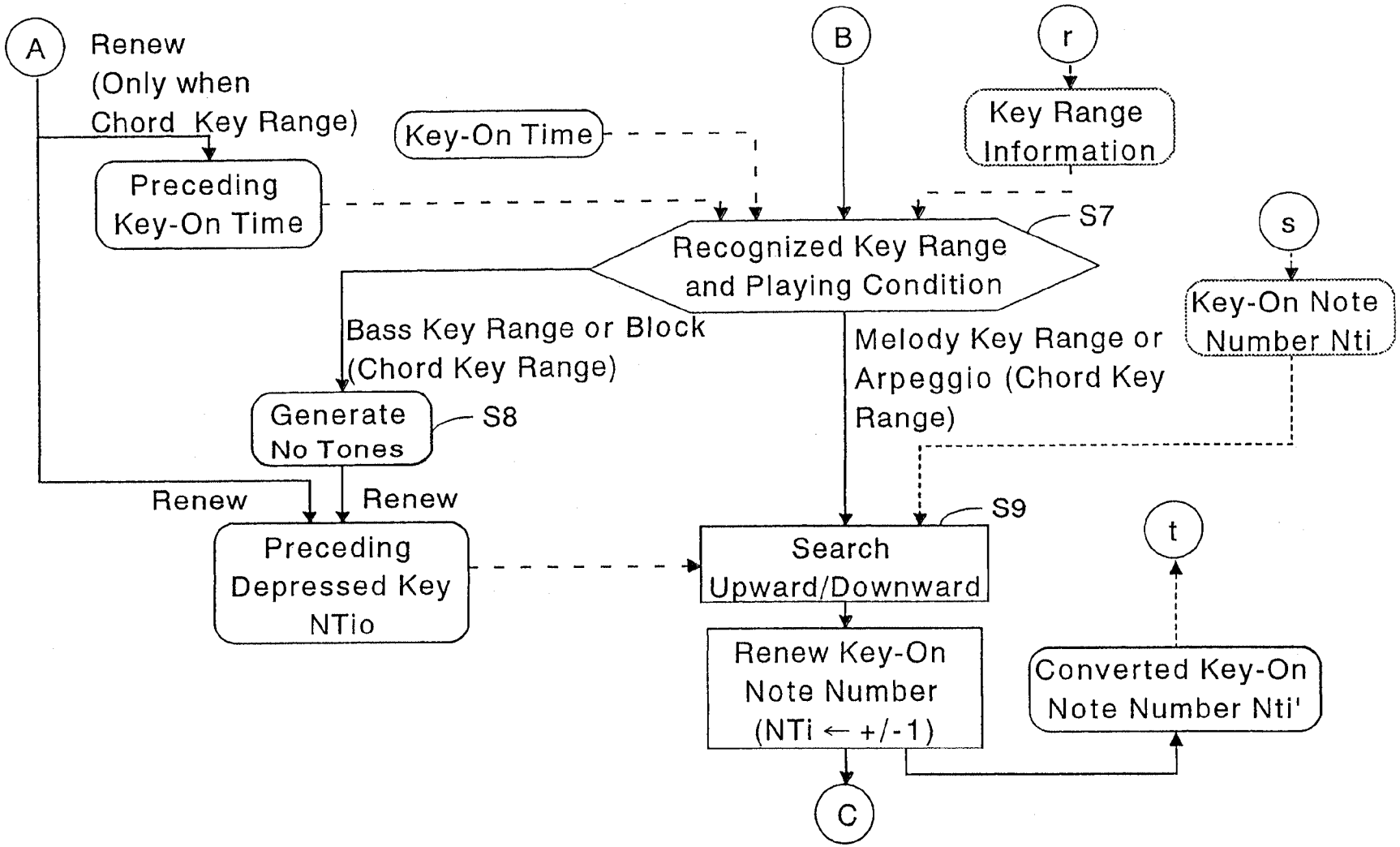

*Fig. 13* Modul Configration
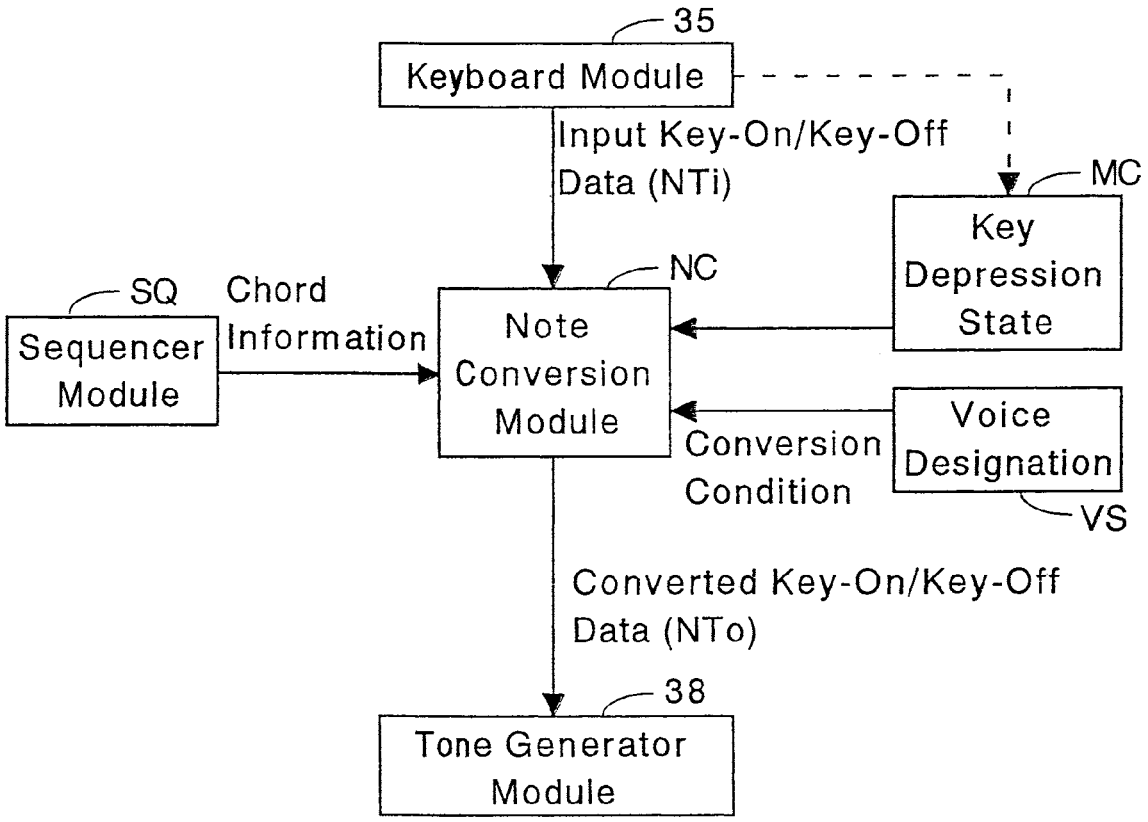

*Fig. 14* Conversion Conditions for Voices

| Parameters | | Voice Kinds (VS) | | | | |
|---|---|---|---|---|---|---|
| | | Guitar | Recorder (Soprano) | Violin | Piano | ··· |
| Maximum Number of Simultaneously Available Tones SM | | 6 | 1 | ··· | ··· | ··· |
| Note Range | Highest Note Number NH | E6(88) | C6(84) | ··· | ··· | ··· |
| | Lowest Note Number NL | E2(40) | C4(60) | ··· | ··· | ··· |
| Playing Condition RC | | Shared among 6 Guitar Strings | None | ··· | ··· | ··· |
| Table | Normal Table NT | TBa | TBb | ··· | ··· | ··· |
| | Tension Table TT | TBt1 | TBt1 | ··· | ··· | ··· |

*Fig.15* Normal Note Conversion Table TBa

| Chord Type | Note Employment Factor | | | | | | | | | | | |
|---|---|---|---|---|---|---|---|---|---|---|---|---|
| | Distance from Root (in Semitones) | | | | | | | | | | | |
| | 0 | 1 | 2 | 3 | 4 | 5 | 6 | 7 | 8 | 9 | 10 | 11 |
| | Note Names for Root of C | | | | | | | | | | | |
| | C | C# | D | E♭ | E | F | F# | G | A♭ | A | B♭ | B |
| Major | 3 | 0 | 0 | 0 | 1 | 0 | 0 | 2 | 0 | 0 | 0 | 0 |
| M7 | 4 | 0 | 0 | 0 | 2 | 0 | 0 | 3 | 0 | 0 | 0 | 1 |
| M6 | 4 | 0 | 0 | 0 | 2 | 0 | 0 | 3 | 0 | 1 | 0 | 0 |
| ⋮ | | | | | | | ⋮ | | | | | |
| Cancel(※) | 1 | 1 | 1 | 1 | 1 | 1 | 1 | 1 | 1 | 1 | 1 | 1 |

*Fig. 16a* Normal Note Conversion Table TBb

| Chord Type | Note Employment Factor | | | | | | | | | | | |
|---|---|---|---|---|---|---|---|---|---|---|---|---|
| | Distance from Root (in Semitones) | | | | | | | | | | | |
| | 0 | 1 | 2 | 3 | 4 | 5 | 6 | 7 | 8 | 9 | 10 | 11 |
| Major | 1 | 0 | 0 | 0 | 1 | 0 | 0 | 1 | 0 | 0 | 0 | 0 |
| M7 | 1 | 0 | 0 | 0 | 1 | 0 | 0 | 1 | 0 | 0 | 0 | 1 |
| M6 | 1 | 0 | 0 | 0 | 1 | 0 | 0 | 1 | 0 | 1 | 0 | 0 |
| ⋮ | | | | | | | ⋮ | | | | | |
| Cancel(※) | 1 | 1 | 1 | 1 | 1 | 1 | 1 | 1 | 1 | 1 | 1 | 1 |

*Fig. 16b* Tension Note Conversion Table TBt1

| Chord Type | Note Employment Factor | | | | | | | | | | | |
|---|---|---|---|---|---|---|---|---|---|---|---|---|
| | Distance from Root (in Semitones) | | | | | | | | | | | |
| | 0 | 1 | 2 | 3 | 4 | 5 | 6 | 7 | 8 | 9 | 10 | 11 |
| Major | 0 | 0 | 1 | 0 | 0 | 0 | 0 | 0 | 0 | 1 | 0 | 1 |
| M7 | 0 | 0 | 1 | 0 | 0 | 0 | 1 | 0 | 1 | 0 | 0 | 0 |
| M6 | 0 | 0 | 1 | 0 | 0 | 0 | 0 | 0 | 0 | 0 | 1 | 0 |
| ⋮ | | | | | | | ⋮ | | | | | |
| Cancel(※) | 1 | 1 | 1 | 1 | 1 | 1 | 1 | 1 | 1 | 1 | 1 | 1 |

*Fig. 16c* Overall Note Conversion Table TBs

| Chord Type | Note Employment Factor | | | | | | | | | | | |
|---|---|---|---|---|---|---|---|---|---|---|---|---|
| | Distance from Root (in Semitones) | | | | | | | | | | | |
| | 0 | 1 | 2 | 3 | 4 | 5 | 6 | 7 | 8 | 9 | 10 | 11 |
| Major | 3 | 0 | 5 | 0 | 1 | 0 | 0 | 2 | 0 | 6 | 0 | 4 |
| M7 | 4 | 0 | 5 | 0 | 2 | 0 | 0 | 3 | 0 | 6 | 0 | 1 |
| M6 | 4 | 0 | 5 | 0 | 2 | 0 | 0 | 3 | 0 | 1 | 0 | 6 |
| ⋮ | | | | | | | ⋮ | | | | | |
| Cancel(※) | 1 | 1 | 1 | 1 | 1 | 1 | 1 | 1 | 1 | 1 | 1 | 1 |

Key-On Event Processing #2 (Part1)

Key-On Event Processing #2 (Part2)

Fig. 18 Key-On Event Processing #2(Part3)
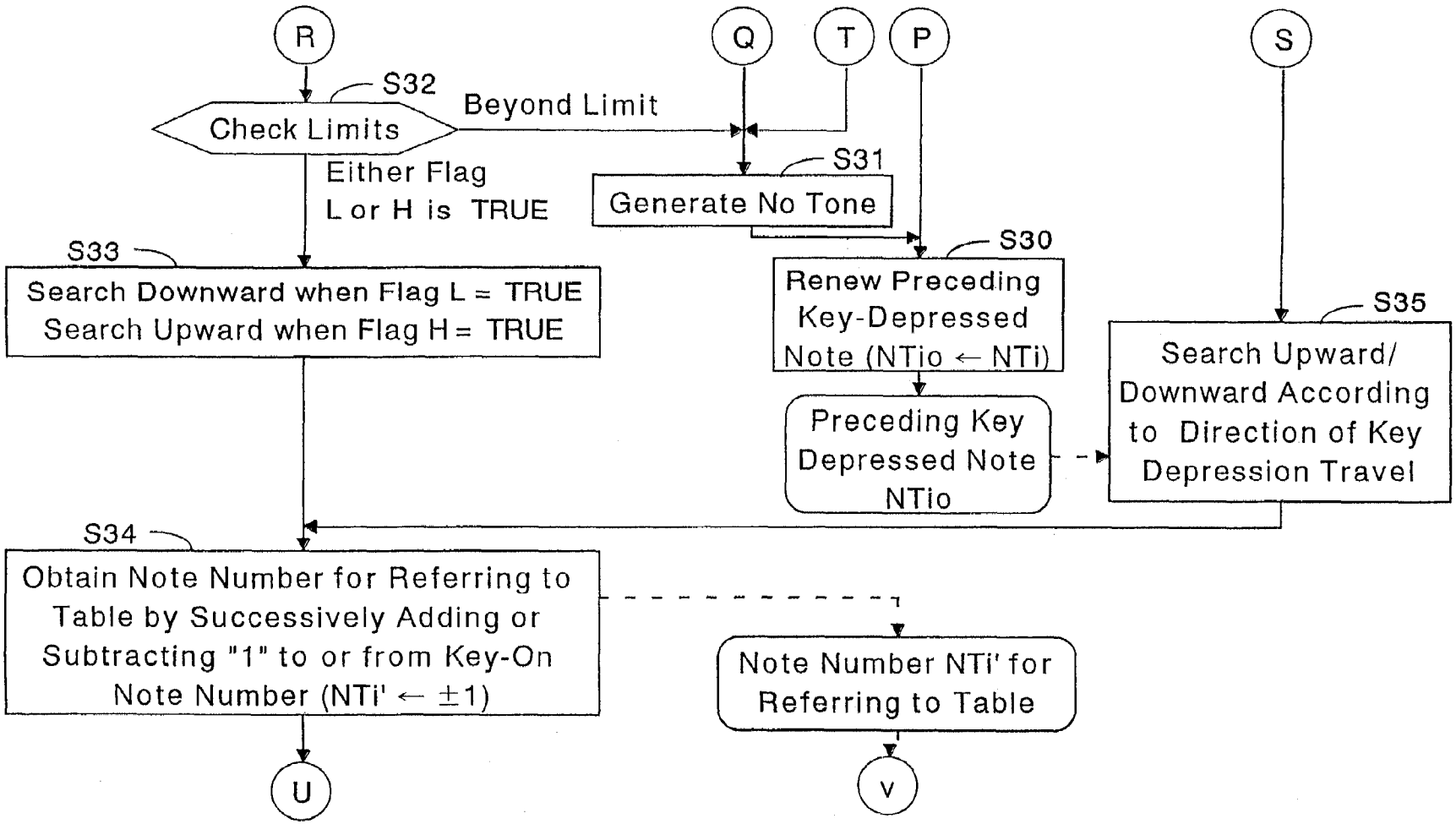

ASSISTIVE APPARATUS AND COMPUTER-READABLE MEDIUM STORING COMPUTER PROGRAM FOR PLAYING MUSIC

This is a continuation of U.S. patent application Ser. No. 10/655,491 filed Sep. 4, 2003, the entire disclosure of which is incorporated herein by reference.

TECHNICAL FIELD

The present invention relates to an assistive apparatus, method, and computer program for playing music, and more particularly to an apparatus, a method and computer program for playing proper music based on rough manipulations by the player, in which a note conversion system provides a chord progression pattern and the player may manipulate the music playing input device even in a rough manner, for example, by depressing potentially incorrect (unacceptable) keys intending a melody, chords or a bass performance, and then the note conversion system converts the inputted incorrect note data to correct (acceptable) note data for the respective currently running chords to generate correct melody notes, chord constituent notes or bass performance notes in view of the chord progression. The apparatus, the method and the computer program are also capable of controlling the tone generation to prevent the note conversion from generating overlapped notes with respect to other concurrently generated notes, converting to notes other than essential chord constituent notes, or converting to notes which will fit not only the currently running chord, but also the prevailing tone color (instrument voice).

BACKGROUND INFORMATION

There have been known in the art such assistive music playing apparatuses that convert roughly played music input signals to proper music playing signals in view of music theory or grammar, so that even a player having poor musical skill and knowledge can enjoy playing music without giving precise care to music theory and grammar. (For example, see unexamined Japanese patent publication No. 1993-27757.)

With a conventional assistive music playing apparatus, however, the inputted music playing signals (i.e. played notes) are uniformly converted to the chord constituent notes or to the scale notes of the designated tonality (key), and may not necessarily make the most of the player's feeling.

Another type of assistive music playing apparatus has been introduced in the art, which apparatus plays back some accompaniment or some music data along with a chord progression and permits the player to play music over such an accompaniment by manipulating the music playing controls such as keys on a keyboard. (For example, see unexamined Japanese patent publication No. 1993-188956.) With such an apparatus, the user may manipulate a key or keys causing generation of a note or notes which may not go well with the concurrently generated accompaniment tones.

A further conceivable method is a method in which the notes played by the user are converted under a prescribed rule to the constituent notes of previously set chords, which method may bring forth a situation where a converted note coincides with another note which is already being generated concurrently. If such coincident notes are generated without care, there may arise a phenomenon of "flanging" (a phenomenon caused by interference of two waveforms, when the pitches, the phases and timbre are very close to each other) resulting in tones quite different from the source or original tones. Further, in the very low frequency range, even though the pitches of two tones are not the same or very close, but if the pitches of two tones are close to some extent, simultaneous sounding of two tones will cause unclear mumbling, thus deteriorating the naturalness of sounds in the acoustic field.

Where the above-mentioned conversion method is employed to convert the user-played notes to the notes which agree with the chord constituent notes under a predetermined rule, no notes other than the chord constituent notes would be generated, even though the user might depress the keys in a manner which would typically cause the generation of notes other than the chord constituent notes, for example by intentionally depressing close black keys or ten keys simultaneously. Such a situation will not be a nuisance from an ordinary point of view in music performance, but will be monotonous and non-surprising with only chord tones to realize a stable music performance.

Further, the above-mentioned conversion method will not cause different conversions for different timbres (voices), or cause conversion to unexpected note pitches which should not be generated normally, or cause conversion to more notes than the number of simultaneously available notes, depending on timbres (voices).

SUMMARY OF THE INVENTION

It is, therefore, a first object of the present invention to provide an assistive music playing apparatus, method and computer program with which the player does not need to pay precise attention in playing (inputting) correct notes but to engage himself/herself in playing music rhythmically and emotionally according to his/her general feeling, thereby to present an acceptable music performance. For this purpose, the apparatus, method and computer program provide chord progression for the player to play music over the chord progression, and convert the potentially unacceptable (incorrect) notes to acceptable (correct) notes with reference to the chord at the time of the note input.

A second object of the present invention is to provide an input note conversion system in which the inputted notes according to the user's playing are converted to the notes which will fit the chord at the time of the note input, and in which the note conversion is controlled so that a plurality of converted notes for simultaneous generation shall not be the same or very close notes depending on the note sub-ranges or on the playing conditions, thereby keeping natural acoustic feeling.

A third object of the present invention is to provide an input note conversion system in which the inputted notes according to the user's playing are converted to the notes which will fit the chord at the time of the note input, and in which the note conversion is controlled so that the converted note may not be limited to basic notes in view of the chord but may be non-basic notes, thereby imparting reality in the performance and pleasing the player in playing with full of variety.

A fourth object of the present invention is to provide an input note conversion system in which the inputted notes according to the user's playing are converted to the notes which will fit the chord at the time of the note input, and in which the note conversion is controlled so that a realistic performance with peculiar features on an actual instrument (voice) will be presented without the user paying particular attention.

According to an aspect of the present invention, the first object is accomplished by providing an assistive music playing apparatus comprising: a chord progression pattern providing device which provides a chord progression pattern representing a series of chords; a note input device which inputs notes constituting music playing along with the chord progression, the inputted notes potentially including unacceptable notes to be subjected to note correction; and a note conversion device which converts the inputted notes, with reference to a current chord in the chord progression at the time of the inputted notes, to converted notes according to conversion characteristics which are differently predetermined for different note sub-ranges as divided in view of note pitches.

According to another aspect of the present invention, the first object is accomplished by providing an assistive music playing apparatus comprising: a chord progression pattern providing device which provides a chord progression pattern representing a series of chords; a note input device which inputs notes constituting music playing along with the chord progression, the inputted notes potentially including unacceptable notes to be subjected to note correction; a note conversion device which converts the inputted notes to first converted notes with reference to a current chord in the chord progression at the time of the inputted notes; and a note reconversion device which reconverts, when a plurality of the first converted notes become the same notes, one of the same notes to another note.

According to a further aspect of the present invention, the first object is accomplished by providing an assistive music playing apparatus comprising: a chord progression pattern providing device which provides a chord progression pattern representing a series of chords; a note input device which inputs notes constituting music playing along with the chord progression, the inputted notes potentially including unacceptable notes to be subjected to note correction; a note conversion device which converts the inputted notes to converted notes with reference to a current chord in the chord progression at the time of the inputted notes according to the number of substantially simultaneously inputted notes, a note distance between the highest note and the lowest note in the substantially simultaneously inputted notes, and the note degree of the highest note from the root of the current chord in the chord progression.

According to a still further aspect of the present invention, the second object is accomplished by providing an input note converting apparatus comprising: a chord information acquiring device which acquires chord information from a chord information providing device; an input note information acquiring device which acquires input note information indicating inputted notes from a musical note input device; a note conversion table which contains note employment factors for indicating a number of notes to be employed for note conversion according to the number of substantially simultaneously inputted notes with respect to respective chord types; a note conversion device which converts notes represented by the input note information to notes which fit the chord type represented by the chord information using the note conversion table; and a note conversion control device which controls the note conversion device so that the converted note shall not overlap with another note which is currently being generated; and further by providing a computer program for executing input note conversion processing in a musical note information processing apparatus which includes a note conversion table containing note employment factors for indicating a number of notes to be employed for note conversion according to the number of substantially simultaneously inputted notes with respect to respective chord types, the input note conversion processing comprising: a procedure of acquiring chord information from a chord information providing device; a procedure of acquiring input note information indicating inputted notes from a musical note input device; a procedure of converting notes represented by the input note information to notes which fit the chord type represented by the chord information using the note conversion table; and a procedure of controlling the note conversion device so that the converted note shall not overlap with another note which is currently being generated.

According to a still further aspect of the present invention, the second object is accomplished by providing an input note converting apparatus comprising: a chord information acquiring device which acquires chord information from a chord information providing device; an input note information acquiring device which acquires input note information indicating inputted notes from a musical note input device; a note conversion device which converts notes represented by the input note information to notes which fit the chord type represented by the chord information; and a note conversion control device which takes the converted note as an output candidate, detects music playing conditions from the input note information, and controls the note conversion device in different manner depending on the detected playing condition so that the converted note shall not overlap with another note which is currently being generated; and further by providing a computer program for executing input note conversion processing in a musical note information processing apparatus, the input note conversion processing comprising: a procedure of acquiring chord information from a chord information providing device; a procedure of acquiring input note information indicating inputted notes from a musical note input device; a procedure of converting notes represented by the input note information to notes which fit the chord type represented by the chord information; and a procedure of taking the converted note as an output candidate, detecting music playing conditions from the input note information, and controlling the note conversion device in different manner depending on the detected playing condition so that the converted note shall not overlap with another note which is currently being generated.

According to a still further aspect of the present invention, the second object is accomplished by providing an input note converting apparatus comprising: a chord information acquiring device which acquires chord information from a chord information providing device; an input note information acquiring device which acquires input note information indicating inputted notes from a musical note input device; a note conversion device which converts notes represented by the input note information to notes which fit the chord type represented by the chord information; and a note conversion control device which compares the note pitches of the note which is currently subjected to note conversion and the preceding input note as to which is higher when there is another note being generated, and controls the note conversion device according to the comparison result so that the converted note shall not overlap with another note which is currently being generated; and further by providing a computer program for executing input note conversion processing in a musical note information processing apparatus, the input note conversion processing comprising: a procedure of acquiring chord information from a chord information providing device; a procedure of acquiring input note information indicating inputted notes from a musical note input device; a procedure of converting notes represented by the input note information to notes which fit the chord type represented by the chord information; and a procedure of comparing the note pitches of the note which is currently subjected to note conversion and the preceding input note as to which is higher when there is another note being generated, and controlling the procedure of converting according to the comparison result so that the converted note shall not overlap with another note which is currently being generated.

According to a still further aspect of the present invention, the third object is accomplished by providing an input note converting apparatus comprising: a chord information acquiring device which acquires chord information from a chord information providing device; an input note information acquiring device which acquires input note information indicating inputted notes from a musical note input device; an input condition discriminating device which discriminates note input conditions from the input note information; a note conversion device which converts notes represented by the input note information to notes which fit the chord type represented by the chord information; and a note conversion control device which controls the note conversion device according to the note input condition as discriminated by the input condition discriminating device so that the converted note shall be a basic note or a non-basic note according to the chord information; and further by providing a computer program for executing input note conversion processing in a musical note information processing apparatus, the input note conversion processing comprising: a procedure of acquiring chord information from a chord information providing device; a procedure of acquiring input note information indicating inputted notes from a musical note input device; a procedure of discriminating note input conditions from the input note information; a procedure of converting notes represented by the input note information to notes which fit the chord type represented by the chord information; and a procedure of controlling the procedure of converting according to the note input condition as discriminated by the procedure of discriminating so that the converted note shall be a basic note or a non-basic note according to the chord information.

According to a still further aspect of the present invention, the third object is accomplished by providing an input note converting apparatus comprising: a chord information acquiring device which acquires chord information representing chord types from a chord information providing device; an input note information acquiring device which acquires input note information indicating inputted notes from a musical note input device; an input condition discriminating device which discriminates note input conditions from the input note information; a note conversion table containing note employment factors which decide available converted notes corresponding to the respective chord types, and including a first sub-table and a second sub-table, the first sub-table containing the note employment factors for converting input notes to basic notes in view of the chord type, and the second sub-table containing the note employment factors for converting input notes also to non-basic notes in view of the chord type; and a table deciding device which decides which of the first and the second sub-table to use for the respective input notes according to the note input conditions of the input note information as discriminated by the input condition discriminating device; and further by providing a computer program for executing input note conversion processing in a musical note information processing apparatus which includes a note conversion table containing note employment factors which decide available converted notes corresponding to the respective chord types, and including a first sub-table and a second sub-table, the first sub-table containing the note employment factors for converting input notes to basic notes in view of the chord type, and the second sub-table containing the note employment factors for converting input notes also to non-basic notes in view of the chord type, the input note conversion processing comprising: a procedure of acquiring chord information representing chord types from a chord information providing device; a procedure of acquiring input note information indicating inputted notes from a musical note input device; a procedure of discriminating note input conditions from the input note information; and a procedure of deciding which of the first and the second sub-table to use for the respective input notes according to the note input conditions of the input note information as discriminated by the procedure of discriminating.

According to a still further aspect of the present invention, the fourth object is accomplished by providing an input note converting apparatus comprising: a chord information acquiring device which acquires chord information representing chord types from a chord information providing device; an input note information acquiring device which acquires input note information indicating inputted notes from a musical note input device; a voice information acquiring device which acquires voice information from a voice information providing device; a plurality of note conversion tables containing note employment factors which decide available converted notes corresponding to the respective chord types; and a note conversion device which converts notes represented by the input note information to notes which fit the chord type represented by the chord information using the note conversion table which is selected from among the plurality of note conversion tables according to the voice information; and further by providing a computer program for executing input note conversion processing in a musical note information processing apparatus which includes a plurality of note conversion tables containing note employment factors which decide available converted notes corresponding to the respective chord types, the input note conversion processing comprising: a procedure of acquiring chord information representing chord types from a chord information providing device; a procedure of acquiring input note information indicating inputted notes from a musical note input device; a procedure of acquiring voice information from a voice information providing device; and a procedure of converting notes represented by the input note information to notes which fit the chord type represented by the chord information using the note conversion table which is selected from among the plurality of note conversion tables according to the voice information.

According to a still further aspect of the present invention, the fourth object is accomplished by providing an input note converting apparatus comprising: a chord information acquiring device which acquires chord information from a chord information providing device; an input note information acquiring device which acquires input note information indicating inputted notes from a musical note input device; a voice information acquiring device which acquires voice information from a voice information providing device; a voice condition storing device which stores note conversion conditions corresponding to the respective voices; and a note conversion device which converts notes represented by the input note information to notes which fit the chord information based on the note conversion conditions corresponding to the voice as designated by the voice information; and further by providing a computer program for executing input note conversion processing in a musical note information processing apparatus which includes a voice condition storing device which stores note conversion conditions corresponding to the respective voices, the input note conversion processing comprising: a procedure of acquiring chord information from a chord information providing device; a procedure of acquiring input note information indicating inputted notes from a musical note input device; a procedure of acquiring voice information from a voice information providing device; and a procedure of converting notes represented by the input note information to notes which fit the chord information based on the note conversion conditions corresponding to the voice as designated by the voice information.

The assistive music playing system (apparatus, method and computer program) according to the present invention converts the potentially unacceptable inputted notes individually to musically acceptable notes with reference to the chord at the time each of the notes is inputted, the chord being provided in the form of a chord progression. An accordingly, there is no need to wait for input of other chord constituent notes, and the processing speed can be accelerated. Further, as the note conversion is conducted differently for different note sub-ranges, the deterioration of chord consonance will be avoided and the user's intention will be fully reflected. Further, as plural notes inputted within a predetermined short period of time are processed as simultaneous inputs for a chord, the converted notes sounds in musically good harmony. Where other notes than the highest note among the simultaneous input notes are processed for note conversion with reference to the highest note to obtain other chord notes, the top note will take a big roll in the harmony and draw strong attention of the listener. The player can, therefore, pay attention mainly to musical expression and emotion without bothered by too precise correctness.

According to the input note conversion processing #1 in the input note conversion system of the present invention, the note conversion table is selected depending on the note range or white/black key distinction, and therefore the inputted notes by the user's music playing can be converted to notes which will well fit the chord at the time of such note input. Further, if the converted candidate note should overlap (including both same or very close) with another currently generated note, the candidate note will be reconverted to further better note which will fit the note range, the playing conditions, and also the relative note heights (which note is higher and which note is lower) by the player's actual playing. More specifically, as the input notes are converted to notes which will fit the currently running chord (in the chord progression), the note conversion is controlled to avoid overlap of notes so that the respective input notes shall not be converted to the same or very close notes at the same time, and accordingly naturalness in auditory feeling will be obtained.

According to the input note conversion processing #2 in the input note conversion system of the present invention, where the actually inputted note by the user are converted to the notes which will fit the chord as supplied from the chord providing device, the note conversion is controlled according to the note input state whether to convert a note under processing to a basic note (i.e. a chord constituent note or a scale note) or to a non-basic note (a tension note or a ornamental note). More specifically, the note conversion table includes a first table containing note employment factors (conversion factors) to output only basic notes and a second table containing note employment factors to output also non-basic notes, and tables are selectively nominated according to the input state by the user. Thus, non-basic notes can be generated in case the user so intends and so plays the note input device such as a keyboard. The user can enjoy music with full of varieties.

According to the input note conversion processing #3 in the input note conversion system of the present invention, a plurality of note conversion tables are prepared showing note employment factors for available converted notes with respect to chord types and instrumental voices, and therefore the voice information can be designated and is taken into consideration in converting the notes. As the inputted notes are converted to fit the chord supplied from the chord providing device, the conversion tables can be selectively utilized according to the voice as instructed by the voice information. Thus, by differentiating the note conversion according to the voices, the payer can expect music playing which fit the voice (timbre) of the generated tones.

According to further features of the present invention, the note conversion conditions including the maximum number of simultaneously available notes and the note sub-ranges are prepared for individual voices, and the voice to be considered in note conversion can be specifically designated. When the input notes are converted to the notes which will fit the current chord, the note conversion is controlled to output suitable notes after conversion using such note conversion conditions prepared in connection with the respective voices. Thus, the player does not need to pay particular attention, but can enjoy the natural playing style as would be peculiar to natural musical instrument according to the designated voice.

BRIEF DESCRIPTION OF THE DRAWINGS

For a better understanding of the present invention, and to show how the same may be practiced and will work, reference will now be made, by way of example, to the accompanying drawings, in which:

FIG. 1 is a block diagram showing a hardware configuration of an assistive music playing system according to an embodiment of the present invention;

FIG. 2 is a block diagram showing a functional configuration of an assistive music playing apparatus according to an embodiment of the present invention;

FIG. 3*b* is a chart showing the user-set parameters for the processing of FIG. 3*a;*

FIG. 3*c* is a musical notation showing the note inputs in the processing of FIG. 3*a;*

FIG. 3*d* is a table for the chord tone distribution as used in the processing of FIG. 3*a;*

FIG. 3*e* is a musical notation showing the note outputs in the processing of FIG. 3*a;*

FIG. 4*b* is a table for the tone numbers to be generated in the processing of 4*a;*

FIG. 4*c* is a table for the chord tones to be employed in the processing of FIG. 4*a;*

FIG. 5*a* is a chart showing the conversion range allocation of a first modification of the assistive music playing apparatus;

FIG. 5*b* is a block diagram showing a functional configuration of the first modification of the assistive music playing apparatus operating with the range allocation of FIG. 5*a;*

FIG. 6*a* is a chart showing the conversion range allocation of a second modification of the assistive music playing apparatus;

FIG. 6*b* is a block diagram showing a functional configuration of the second modification of the assistive music playing apparatus operating with the range allocation of FIG. 6*a;*

FIG. 7 is a block diagram showing a functional configuration of a third modification of the assistive music playing apparatus;

FIG. 8 is a block diagram showing a hardware configuration of an input note conversion system according to an embodiment of the present invention;

FIG. 9 is a block diagram showing a module configuration of an input note conversion system according to an embodiment of the present invention to describe the outline of a note conversion function in a first fashion;

FIG. 10 is an example of a note conversion table used in an embodiment of the present invention;

FIGS. 11 and 12, in combination, are a flow chart describing a key-on event processing in the note conversion processing according to an embodiment of the present invention;

FIG. 13 is a block diagram showing a module configuration of an input note conversion system according to an embodiment of the present invention to describe the outline of note conversion function in a second and a third fashion;

FIG. 14 is an example of the table of conversion conditions for the respective voices according to an embodiment of the present invention;

FIG. 15 is an example of the normal note conversion table as used in an embodiment of the present invention;

FIG. 16*a* is another example of the normal note conversion table as used in an embodiment of the present invention;

FIG. 16*b* is an example of the tension note conversion table as used in an embodiment of the present invention;

FIG. 16*c* is an example of the overall note conversion table as used in an embodiment of the present invention; and FIGS. 17*a*, 17*b* and 18, in combination, are a flow chart describing another key-on event processing in the note conversion processing according to another embodiment of the present invention.

DESCRIPTION OF THE PREFERRED EMBODIMENTS

Assistive Music Playing System

Figure 3A:
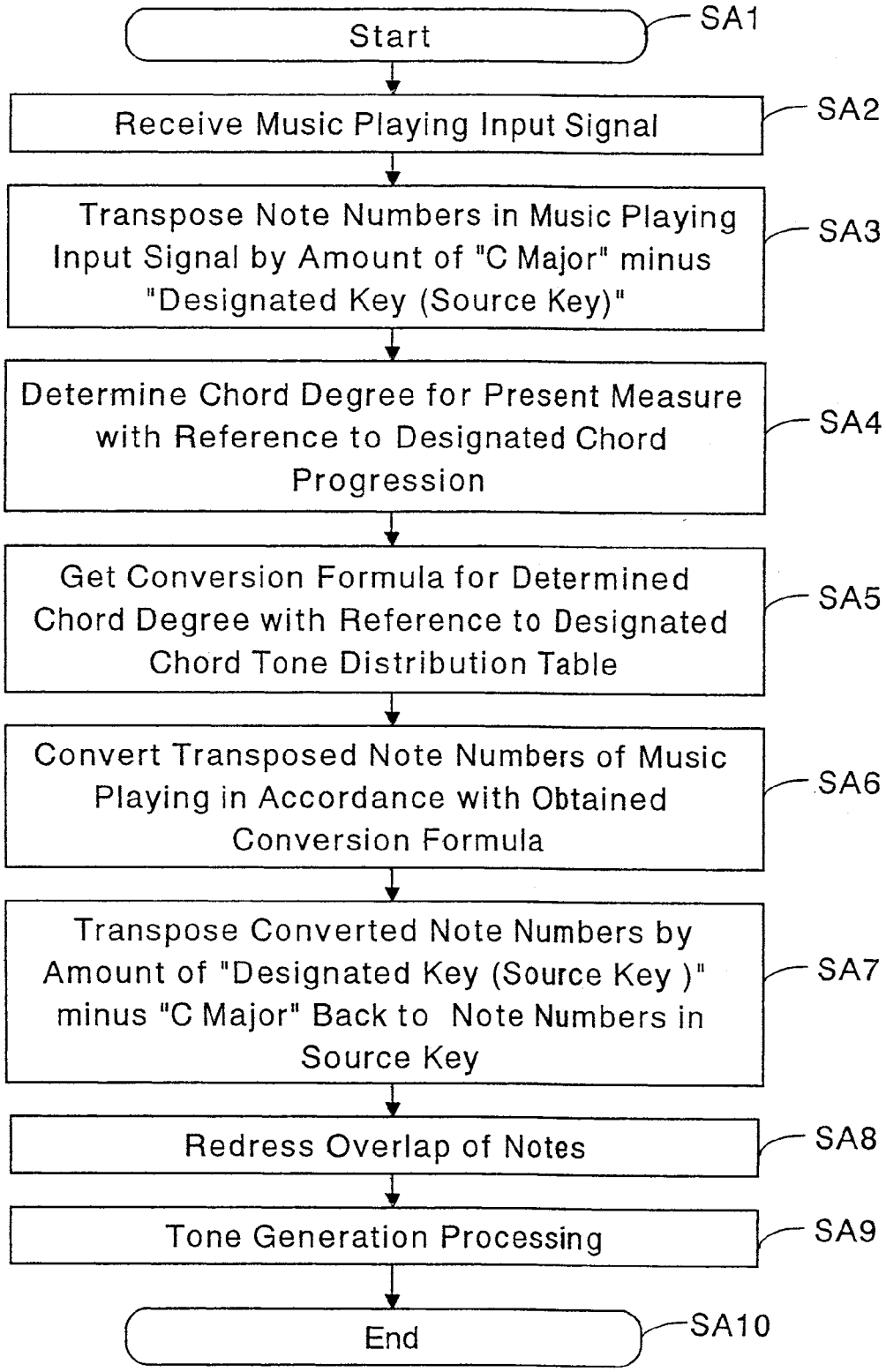
FIG. 3*a* is a flow chart describing a first embodiment of the music playing assist processing.

Illustrated in FIG. 1 of the drawings is a block diagram illustrating a hardware configuration of an assistive music playing system according to an embodiment of the present invention. The assistive music playing system comprises an assistive music playing apparatus 1, whose hardware configuration is common to all the embodiments described herein.

The assistive music playing apparatus 1 comprises a RAM 3, a ROM 4, a CPU 5, an external storage device 7, a control detecting circuit 8, a display circuit 10, a tone generator circuit 12, an effect circuit 13, a MIDI interface 16 and a communication interface 17, all of which are interconnected by a bus 2.

A user can set various conditions and parameters using panel controls 9 connected to the control detecting circuit 8. The panel controls may be of any arbitrary types such as a rotary encoder, a switch, a mouse, a character inputting (i.e. alphanumeric) keyboard, a joystick and a jog shuttle, as long as they output signals representing the user's control inputs. Further, the panel controls may be soft switches displayed on the screen of a display 11 operatable by another control means such as a mouse.

The display circuit 10 is connected to the display device 11 to display various information and presentation on the display screen.

The external storage device 7 includes an interface so as to be connected to the bus 2. The external storage device may be, for example, a flexible disk drive (FDD), a hard disk drive (HDD), a magneto-optical disk (MO) drive, a CD-ROM (compact disk read only memory) drive, a DVD (digital versatile disk) drive, a semiconductor memory, or else. The external storage device 7 may store various parameters, various data, a computer program for practicing the embodiment (called "music playing assist program"), music performance information, and so forth.

The RAM 3 includes working areas for the CPU 5 to store flags, registers, buffers or buffers, various parameters, etc. The ROM 4 may store various parameters and control programs, or programs for realizing the embodiments. The CPU 5 conducts arithmetic operations and controls according to the control programs stored in the external storage device 7. A timer 6 is connected to the CPU 5 to provide the basic clock signal, the interrupt process timing, etc. to the CPU 5.

The tone generator 12 is to generate musical tone signals in response to musical performance signals such as music performance data MD stored in the external storage device 7 and MIDI signals supplied from music playing controls (or device) 15 or from a MIDI apparatus 18 connected to the MIDI interface 16, and the musical tone signals are sent to the effect circuit 13 and then to a sound system 14 to be emitted as audible sounds.

The type or fashion of the tone generator may be a waveform memory type, an FM synthesis type, a physical model type, a harmonics synthesis type, a formant synthesis type, an analog synthesizer type having VCOs, VCFs and VCAs, an analog simulation type, or any other type available in the art. The tone generator circuit 12 may be of a hardware structure exclusively functioning as a tone generator, or may be of a combination of a DSP (digital signal processor) and a microprogram, or may be of a combination of a CPU and a software thereby functioning as a tone generator. And may be of any combination of the above-mentioned types. Further, a single or small number of hardware circuits may be used in a time division multiplex fashion to provide a plurality of tone generating channels, or plural separate (individual) hardware circuits may be provided to constitute respective ones of a plurality of tone generating channels.

The effect circuit 13 is to impart various sound effects to the tone signals of digital form supplied from the tone generator 12. The sound system 14 includes D/A converters and loudspeakers to convert the supplied digital musical tone signals into analog signals and emit as audible sounds in the atmosphere.

The music playing controls or device 15 are connected to the control detecting circuit 8 to supply music playing signals or performance signals in accordance with the music playing movements or manipulations of the user (i.e. music player). In the preferred embodiments herein, the music playing controls 15 are keys of a music-playing keyboard. Anyway, the music playing controls 15 may be of any other type of controls as long as they are at least capable of outputting performance signals such as in a MIDI format.

The MIDI interface (MIDI I/F) 16 is the one which is connectable to an electronic musical instrument, other kinds of musical instrument, an audio apparatus, a computer, etc., and is at least capable of transmitting and receiving MIDI signals. The MIDI interface 16 is not necessarily limited to a dedicated (i.e. exclusive) MIDI interface, but also may be formed by using a general-purpose interface such as an RS-232C, a USB (universal serial bus) and IEEE1394. In such a case, the interface may be so designed to transmit also other data than MIDI messages together with the MIDI messages.

The MIDI apparatus is an audio apparatus, a musical instrument, or else which is connected to the MIDI interface 16. The form of the MIDI apparatus is not limited to a keyboard type musical instrument, but also may be a string instrument type, a wind instrument type, a percussion instrument type, or else. Further, the MIDI apparatus may be an electronic musical instrument which incorporates a tone generator device, an automatic performance device, etc. in a single console, or may be configured by interconnecting separate individual such devices via communication means such as MIDI network and other various networks. The user can play (i.e. manipulate, control, operate) the MIDI apparatus 18 to input music playing signals. The MIDI apparatus 18 may serve as controls for inputting various data and various settings other than music playing data.

The communication interface 17 is connectable to a communication network 19 such as a LAN (local area network), Internet and a telephone line, so that the assistive music playing apparatus 1 can be connected to a server computer 20 via the communication network 19. Thus, the user can download control programs, programs for realizing the embodiment, music performance data, and so forth from the server computer 20 into the external storage device such as an HDD, or into the RAM 4, or else. The communication interface 17 and the communication network 19 may be of a cable type or of a wireless (radio) type, or both.

FIG. 2 is a block diagram illustrating a functional configuration of an assistive music playing apparatus 1 of FIG. 1 to be used for type 1 and type 2 note conversion. The assistive music playing apparatus 1 of this embodiment is comprised of a music playing input unit 21, a chord progression providing unit 22 and a note conversion unit 23.

The music playing input unit 21 is comprised, for example, of the music playing controls 15 and the control detecting circuit 8, or of a MIDI apparatus 18 of FIG. 1, and supplies music playing signals to the note conversion unit 23.

The chord progression providing unit 22 is comprised, for example, of the ROM 4 or the external storage device 7 and stores a plural chord progression data sets (files). A chord progression data set is a series of chord data representing an array of chords in terms of chord names or chord degrees for a length of music piece. The chord progression data set may be of the actual chord progression of a particular existing music piece or may be of an arbitrarily created train of chords (as long as not incorrect in music theory). The data set may further contain additional performance data such as of a drum performance or another part performance. In this embodiment, chords are identified and handled in terms of the key (tonality) plus the degree, thereby interpreting the function of the respective chords from a musical point of view. In this connection, the chord progression data are expressed and stored in terms of chord degrees (e.g. I, IIm), so that the user designate a running key or tonality (e.g. F) for the chord progression, thereby determining the actual individual chord names (e.g. F, Gm). Alternatively, the key information may be included in the file of chord progression data set. Further alternatively, actual chord names may be stored as the chord progression data in place of chord degrees, and then the key information will be dispensed with.

The chord progression providing unit 22 supplies the chord progression data set as designated by the user to the note conversion unit 23. The note conversion unit 23 is to convert the potentially incorrect note numbers contained in the music playing signals supplied from the music playing input unit 21 to musically correct note numbers based on the chord progression data supplied from the chord progression providing unit 22, even though the music playing input may contain some incorrect note numbers contrary to the player's intention. The embodiment provides two types of note conversion units conducting music playing assist processing #1 and #2, respectively as described herein below.

The music playing assist processing #1 will be described according to a flow chart of FIG. 3*a* together with reference to FIGS. 3*b*-3*e*. This processing #1 incorporates the type 1 note conversion, in which the note numbers (note pitch information) of the respective inputted notes (music playing signals) are converted to proper note numbers uniformly applying the rules in the table for chord tone distribution CDT as shown in FIG. 3*d*. Namely, each inputted note number, whether it is a solo note or a chord constituent note, is compared with the table CDT to find a correction factor, and is then modified by the factor thus found.

The chord tone distribution is a rule defining a modification amount (correction factor) for each of the note numbers "0" through "127" with respect to each of the chord degrees. For example, the rule of chord tone distribution is that the treble tone range permits the maximum use of the inputted note number per se as long as available for a tension note, that the middle tone range permits the use of a chord constituent note, that the lower middle tone range permits the use of the root and the fifth note of a chord, and that the bass tone range permits the use of only the root note of a chord. The inputted note numbers are converted accordingly. With the music playing assist processing #1, all of the inputted note numbers will be converted (i.e. modified) according to the chord tone distribution rules mentioned above to realize note conversions to meet the harmony nature. There are prepared a plurality of chord tone distribution tables having different conversion characteristics (factors), and the user will designate a desired one by setting the user-set parameters US (FIG. 3*b*).

FIG. 3*a* is a flow chart describing the music playing assist processing #1. This music playing assist processing is an interrupt processing which is initiated by the user's instruction and is activated at every prescribed interrupt timing thereafter.

The user first set the user-set parameters US as shown in FIG. 3*b*, before instructing the activation of this music playing assist processing. The user-set parameters include key information which represents the tonality key of the music piece to be played, information which identifies a chord progression (e.g. music number selecting information) and information which identifies a chord tone distribution table CDT to be described later.

The processing is started at a step SA1 and then receives the music playing input signals at a step SA2. In this example, it is assumed that the music playing input signals SI containing three notes as shown in FIG. 3*c* are inputted by the user's music performance. The music playing input signals SI include three note events (tone generation instructions) respectively representing note numbers 75 (D#), 71 (B) and 69 (A).

A step SA3 transposes, i.e. shifts, the note numbers in the music playing input signals SI received in the step SA2 by the amount of the "C major key" minus the "designated key (source key)" included in the user-set parameters. The difference is to be expressed in the modulo of "12" so that, for example, "−5" becomes "7." In the illustrated example, the designated key included in the user-set parameters US is "F major," which makes "C major" minus "F major" is "7," and this value "7" is added to the note numbers of the respective note events. Thus, the obtained note numbers are: "75+7=82" (A#5), "71+7=78" (F#5) and "69+7=76" (E5).

A step SA4 determines the chord degree for the present (current) measure with reference to the designated chord progression in the user-set parameters US (FIG. 3*b*). If, in this example, the current measure is the second measure in the progression, the chord degree is determined to be "V" (the dominant chord).

A step SA5 gets a conversion formula for the above-determined chord degree with reference to the chord tone distribution table as previously designated by the user in the user-set parameters US. As the chord degree determined at the step SA4 is "V," reference is now made to the column of "V" in the chord tone distribution table CDT of FIG. 3*d* to get a conversion formula for a set of three note numbers "82" (A#), "78" (F#) and "76" (E) as transposed at the step SA3 from the music playing input signals SI. Thus obtained conversion formula consists of three conversion factors "1," "1" and "−2." The chord tone distribution table CDT shown in FIG. 3*d* is only a part of the entire table for the purpose of explanation here.

While the chord tone distribution table shown in FIG. 3*d* contains conversion factors for the respective note numbers with respect to the respective chord degrees, the table may contain note numbers after conversion per se instead.

A step SA6 converts the transposed note numbers at the step SA3 from the music playing input signals SI in accordance with the conversion formula (factors) obtained at the step SA5. In this example, the three conversion factors "1," "1" and "−2" are respectively added to the corresponding transposed note numbers "82" (A#), "78" (F#) and "76" (E) as shifted at the step SA3 from the music playing input signals SI, thereby obtaining converted note numbers "83" (G), "79" (C) and "74" (D).

A step SA7 reverse transpose the above converted note numbers as shifted at the step SA6 from the music playing input signals SI by the amount of the "designate key (source key)" minus "C major" back to the note numbers in the source key. In this example, the designated key included in the user-set parameters US is "F major," which makes "F major" minus "C major" equals "−7" (in modulo of "−12"), and this value of "−7" is added to the note numbers of the respective note events to obtain reverse transposed note numbers back in the source key of "F major." Thus, the obtained note numbers are: "83−7=76" (E), "79−7=72" (C) and "74−7=67" (G). The value "−7" may be determined by reversing the sign of "+7" as obtained at the step SA3.

Through the above described process, the music playing input signals SI containing three notes as shown in FIG. 3*c* are converted to note outputs SO constituting a corrected chord containing the note numbers "76" (E), "72" (C) and "67" (G) as shown in FIG. 3*e* in musical notation.

A step SA8 detects overlapping note numbers, if any, after conversion contained in the output signals SO (a state in which two or more input note numbers have been converted to a single same output note number). In the case where any overlap is detected, for example, the note number of the later (or earlier) input event is reconverted to the note number of the row having the factor of "0" which row is nearest to and below (or above) the note number to which the earlier (or later) input note number has been converted in the chord tone distribution table CDT, to be outputted as the revised converted note number in the output signals SO. For example, if the current chord degree is "IV" (subdominant chord) and the source input note numbers are "76" (E) and "79" (G), the note conversion at the step SA7 gives the same note numbers "77" (F) for the both. In such a situation, the later (or earlier) arrived note number is converted to the note number "81" (A) having a factor of "0" in its row further above the overlapped one. If no overlap is detected in the converted note numbers, the converted note numbers per se as obtained at the step SA7 are outputted as the music playing output signals SO.

A step SA9 conducts processing of tone generation based on the music playing output signals SO. The tone generation processing is conducted by supplying the output signals SO to the tone generator 12 of FIG. 1. In place of tone generation, the output signals SO may be stored in the external storage device 7 or in a temporary storing area of the RAM 3. Further, the output signals SO may be outputted to an external apparatus via the MIDI interface 16 or via communication network 17. The step SA9 may include all of these processing, or may conduct one or more processing according to the user's designation. The processing then proceeds further to a step SA10 to terminate the assistive music playing processing #1.

According to the above described processing #1, all the note numbers in the music playing input signals are individually converted, and therefore the same number of tones as the number of inputted tones can be generated, which means that the number of generated tones are maintained as intended by the music player.

According to the embodiment which utilizes the chord tone distribution tables of different conversion factors depending on the tone range, the density of generated tones can be variously determined to prevent deterioration of the chord harmony. This can reflect the intention of the player more correctly.

The individual conversion of the note numbers of the inputted music playing signals will obviate waiting for other chord constituent notes, thereby increasing the processing speed, which will be advantageous in processing real time.

The music playing assist processing #2 will be described according to a flow chart of FIG. 4*a* together with reference to FIGS. 4*b*-4*c*. This processing #2 incorporates the type 2 note conversion, in which the number of notes contained in the music playing input signals SI ("NumberOfNotes"), the range between the note number of the bottom (lowest) note and the note number of the top (highest) note in the inputted music playing signals SI ("Range") and the degree interval of the top note from the root note of the key indicated by the key designation in the user-set parameters US ("TopNoteDegree") are used to create a chord giving most musically beautiful consonance.

Figure 4A:
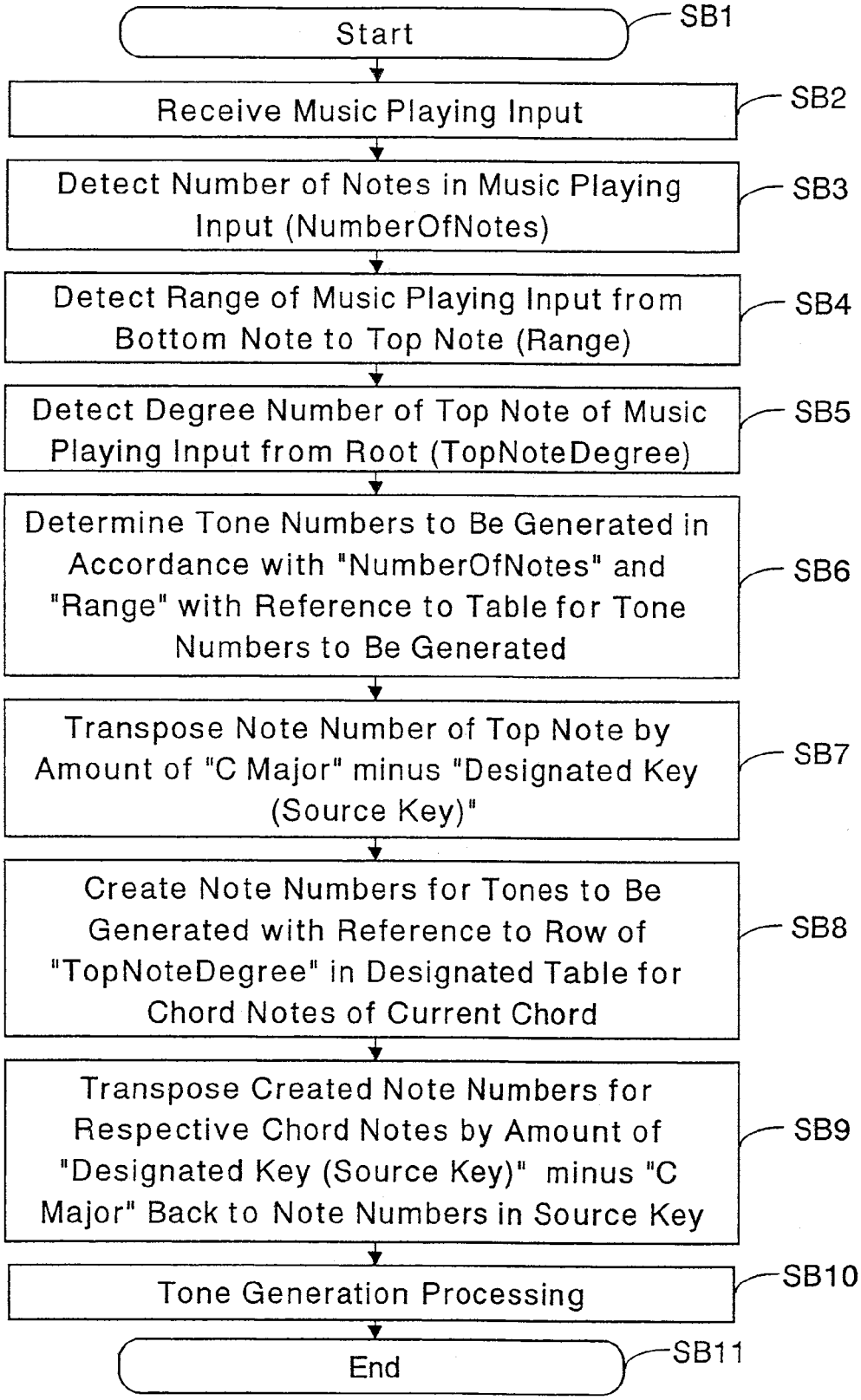
FIG. 4*a* is a flow chart describing a second embodiment of the music playing assist processing.

FIG. 4*a* is a flow chart describing the music playing assist processing #2. This music playing assist processing is an interrupt processing which is initiated by the user's instruction and is activated at every prescribed interrupt timing thereafter.

FIG. 4*b* is an example of a table for tone numbers to be generated TNT which is referred to in the music playing assist processing #2 of the present invention. The tone number table TNT is a table for determining tone numbers to be generated GTN (as will be referred to in FIG. 4*c*) based on the number of notes ("NumberOfNotes") and the top-bottom range ("Range").

FIG. 4*c* is an example of a table for determining note numbers of the chord tones to be generated (CNT) which will be referred to in the music playing assist processing #2 of the present invention. The chord note determining table CNT is a table for determining the notes to constitute the subject chord to realize most musically beautiful consonance depending on the number of notes to be generated for the subject chord. This example table CNT gives conversion factors in terms of offset value from the top note based on the top note degree (TND) and the tone numbers to be generated (GTN) as are obtained from the table for tone numbers to be generated (TNT) of FIG. 4*b*. There are prepared plural chord note determining tables (CNT) for different musical categories (genres) such as normal, rock and jazz, in which further a sub-plurality of tables with respect to different chord degrees ("ChordDegree") are prepared for each of the categories. Shown in FIG. 4*c* is a chord note determining table CNT of the part corresponding to the "Normal" category and the "ChordDegree"="V."

Herein below will be described the music playing assist processing #2 with reference to FIGS. 4*a*-4*c*. Also in this processing #2, it is assumed that the user-set parameters US are previously set as in FIG. 3*b*, except the item of <Table for Chord Tone Distribution> has been replaced by <Chord Note Determining Table> designation.

The processing is started at a step SB1 and then receives the music playing input signals at a step SB2. In this example also, it is assumed that the music playing input signals SI containing three notes as shown in FIG. 3*c* are inputted by the user's music performance. Further, a plurality of note events included in the music playing input signals SI received within a predetermined short period time (e.g. 49 ms) are deemed to constitute a chord, and the below described processing is conducted with respect to such plural note events inputted within the predetermined period of time.

A step SB3 detects the number of note events included in the input signals SI received at the step SB2 and constituting a chord, and make the detected number to be "NumberOfNotes." In this example, "NumberOfNotes" is "3."

A step SB4 detects the difference between the highest note (i.e. top note) having the greatest note number and the lowest note (i.e. bottom note) having the smallest note number among the note events as inputted at the step SB2, and makes this difference value to be the note range ("Range"). In this example, "Range" is "75 (top note)"−"69 (bottom note) "="6."

A step SB5 detects the degree number of the top note among the note events included in the music playing input signals as received at the step SB2 from the root note of the subject chord ("TopNoteDegree"). In this example, the designated key in the user-set parameters US is "F major" and therefore the root note is "F" (65). Thus, "TopNoteDegree"="75" (D#, the top note)−"65" (F, the root note)="10."

A step SB6 determines tone numbers to be generated (GTN) in accordance with afore-detected "NumberOfNotes" ("3") and "Range" ("6") with reference to the table for tone numbers to be generated (TNT) of FIG. 3*b*. In this example, "NumberOfNotes" is "3" and "Range" is "6" (where "Range"<12), which gives an answer of "1, 2, 3" for the tone numbers to be generated (GNT).

A step SB7 transposes or shifts the note number of the top note included in the note events received at the step SB2 by the amount of "C major" minus the "designated key (source key)." In this example, the "designated key" in the user-set parameters is "F major," which makes "C major" minus "F major" equals "7" (in semitones). This value "7" is added to the note numbers in the inputted note events to obtain transposed note numbers. Thus, the transposed note number of the top note is "75+7=82" (A#).

A step SB8 creates note numbers for the respective tone numbers to be generated with reference to the row of "TopNoteDegree" in the designated table for chord notes of the current chord as designated by the user-set parameters US of FIG. 3*b*. In this example, the chord note determining table CNT of "Normal" category and for "ChordDegree" of "V" (dominant chord) is looked up at the columns of the tone numbers "1," "2" and "3" and at the row of "TopNoteDegree" ("10") to find offset values of "1," "−8" and "−3." These offset values are then added individually to the note number of the top note "82" (A#) to create note numbers "83" (B), "74" (D) and "79" (G).

A step SB9 transposes the created note numbers at the step SB8 for the respective chord notes in response to the input key events by the amount of the "designated key (source key)" minus "C major back to note numbers in the source key. In this example, the designated key in the user-set parameters is "F major" and "Designated Key" minus "C major" is "−7," which in turn is added to the above obtained respective note numbers. Reverse transposition of the respective note numbers are: "83−7=76" (E), "79−7=72" (C) and "74−7=67" (G). The value of "−7" may be obtained by inverting the sign of the value "7" as obtained by the step SB7. Thus, the output music playing signals will be the same as the output SO of FIG. 3*e*.

A step SB10 conducts processing of tone generation based on the music playing output signals SO including the respective note events as transposed back to the source key at the step SB9. The tone generation processing is the same as in the processing #1 mentioned before. The processing then proceeds further to a step SB11 to terminate the assistive music playing processing #2.

According to the processing #2, a plurality of note events inputted within a predetermined short time period are handled as a chord event (deemed to be simultaneous occurrences), and therefore the note conversion processing is designed and conducted to present musically beautiful consonance.

Where all the chord constituent notes are created with reference to the top note among the inputted note events, the top note is fully used or relied upon to realize good musical consonance. While the chord note determining table stores offset values from the top notes, which offset values are added to the top note to create the respective chord constituent notes, the chord constituent notes may be obtained with reference to the bottom note or other another note other than the top note. However, for the note conversion in the treble range and the middle range, the reference note should preferably be the top note for creating other chord constituent notes.

Further, while the number of notes to be generated is limited to "4" at maximum, other number may be employed within the numbers which will usually occur in the ordinary music playing.

In the above explanation about two types of music playing assist processing #1 (FIG. 3) and #2 (FIG. 4), the normalization of the designated key to the reference key of "C major" is conducted by "C major" minus the "Designated Key" to obtain the transposition amount and thus calculated transposition amount is added to each input note number to obtain each normalized note number. Also in the above explanation, the final reverse transposition (reverse normalization) is effected by obtaining the reverse transposition amount by "Designated Key" minus "C major" and by adding thus calculated reverse transposition amount to each converted normalized note number. However, the arithmetic operations may be reversed to effect the same result, as will be understood by a person skilled in the theory of music. Namely, the normalization of the designated key to the reference key of "C major" may be conducted by the "Designated Key" minus "C major" to obtain an alternative transposition amount, and thus calculated alternative transposition amount is subtracted from each input note number to obtain each normalized note number. And the reverse normalization may be effected by adding (in place of subtracting) the above alternative transposition amount to each converted normalized note number.

A first modification of the assistive music playing apparatus according to the present invention will be described hereunder with reference to FIGS. 5*a* and 5*b*. FIG. 5*a* is a chart showing the conversion range allocation of the first modification, in which the music playing controls 15 (FIG. 1) such as a keyboard is divided into two ranges at an arbitrarily predetermined split point SP which is any point between the note number "0" and the note number "127." For the note numbers below the split point SP (range of notes to be converted), the note events will be subjected to note conversion, and for the note number from the split point SP and above (range of notes not to be converted), the note events will not be subjected to note conversion.

FIG. 5*b* is a block diagram of the functional configuration of the first modification 51 of the assistive music playing apparatus 1 of FIG. 2, according to the present invention. The assistive music playing apparatus 51 is comprised of a music playing input unit 21, a chord progression providing unit 22 and a note conversion unit 23 similarly to the assistive music playing apparatus 1 of FIG. 2. The chord progression providing unit 22 and the note conversion unit 23 function similarly to the assistive music playing apparatus 1 of FIG. 2, while only the music playing input signals below the split point SP are supplied to the note conversion unit 23 and are subjected to note conversion, and the music playing input signals from the split point and above are not supplied to the note conversion unit 23, but supplied directly to the tone generator 12 (FIG. 1) for direct tone generation.

This type of assistive music playing apparatus is very suitable for such a player who wants to play an entire melody himself or herself which would usually use a higher note range (above the split point SP) but may be unskillful in playing chord accompaniment which would use a lower note range (below the split point SP), so that the player can enjoy playing music with a simple melody and some complicated chords, being assisted by the apparatus of the present invention.

The split point SP can be set at any arbitrary point, and further a plurality of split point may be provided. In the latter case, each fractional range divided by the split points may be set to be either note conversion range or non-conversion range. The non-conversion range can be realized by incorporating the chord tone distribution table and setting all the conversion factors (offset values) to be "0" in the non-conversion range.

A second modification of the assistive music playing apparatus according to the present invention will be described hereunder with reference to FIGS. 6*a* and 6*b*. FIG. 6*a* is a chart showing the conversion range allocation of the second modification, in which the music playing controls 15 (FIG. 1) such as a keyboard is divided into two ranges at an arbitrarily predetermined split point SP which is any point between the note number "0" and the note number "127." For the note numbers from the split point SP and above (range of notes to be converted by type 1 unit), the note events will be subjected to note conversion through the music playing assist processing #1, and for the note number below the split point SP (range of notes to be converted by type 2 unit), the note events will be subjected to note conversion through the music playing assist processing #2.

FIG. 6*b* is a block diagram of the functional configuration of the second modification 61 of the assistive music playing apparatus 1 of FIG. 2, according to the present invention. The assistive music playing apparatus 61 is comprised of a music playing input unit 21, a chord progression providing unit 22, a note conversion unit (type 1) 23*a*, and a note conversion unit (type 2) 23*b*. From the music playing input unit 21, the music playing input signal of and above the split point SP are supplied to the note conversion unit (type 1) 23*a* and the music playing input signal below the split point SP are supplied to the note conversion unit (type 2) 23*b*.

The note conversion unit (type 1) 23*a* conducts, for example, note conversion according to the above mentioned music playing assist processing #1, while the note conversion unit (type 2) 23*b* conducts, for example, note conversion according to the above mentioned music playing assist processing #2. As the higher note range which is the range of notes to be converted by type 1 conversion unit is mostly used for playing a monophonic melody, it is advantageous to use the music playing assist processing #1 which converts the inputted music playing signals individually. And, as the lower note range which is the range of notes to be converted by type 2 conversion unit is mostly used for playing a chord accompaniment, it is advantageous to use the music playing assist processing #2 which converts the inputted music playing signals collectively as a chord.

The use of different types of conversion processing for different key range of the keyboard will permit to make the most of the advantageous aspects of the respective conversion types. The split point SP can be set at any arbitrary point, and further there can be set a plurality of split points SP. In the latter case, the type of note conversion processing to be conducted at each of the ranges as divided by the split points can be selectively set by the user. Further, in the case where a plurality of split points are provided, some of the divided ranges may be allocated for non-conversion range as in the above described first modification.

The note conversion types may not necessarily be limited to the types as described above, but may be of any types as long as they are different. Further, the relations between the conversion types and the key ranges may be different from the above mentioned relations. For example, the note conversion unit (type 1) 23*a* may conduct the note conversion processing #2 and the note conversion unit (type 2) 23*b* may conduct the note conversion processing #1.

FIG. 7 is a block diagram showing a functional configuration of a third modification of the assistive music playing apparatus 71 according to the present invention. The assistive music playing apparatus 71 is comprised of a music playing input unit 21, a chord progression providing unit 22, a note conversion unit 23 and an automatic accompaniment/additional note generating unit 24. The note conversion unit 23 is to convert music playing input signals supplied from the music playing input unit 21 based on the chord progression supplied from the chord progression providing unit 22. Note conversion processing by the note conversion unit 23 may be either of the afore mentioned #1 type conversion processing and #2 type conversion processing, or may include both of them with a split point SP provided as in the second modification embodiment. Further, a non-conversion sub-range may be provided as in the first modification embodiment.

The automatic accompaniment/additional note generating unit 24 is to generate an automatic accompaniment and/or additional notes based on the chord progression supplied from the chord progression providing unit 22 and the note-number-converted music playing input signals supplied from the note conversion unit 23. As the same chord progression is supplied in common to the automatic accompaniment/additional note generating unit 24 and to the note conversion unit 23, the generated automatic accompaniment and the generated additional notes will exhibit good consonance with the note-number-converted music playing input signals (for example, both a chord and one or more additional notes will be given to each top note after conversion of the inputted music playing signals).

The music playing signals SI which are inputted as subjects of conversion in the music playing assist processing are, for example, music performance signals in the MIDI format and are comprised of a plurality of note events (note-ons and note-offs) including at least note pitch information such as note numbers. In addition to note pitch information, each note event usually includes, information for controlling the note sounding way or manner of the note event such as note length information, tone volume information, and so forth. In the music playing assist processing (both #1 and #1) of the present invention, only the note numbers (i.e. pitch information) in the music playing signals SI are converted. This means that the note sounding length information, tone volume information, and other information will be outputted without change as the player has intended, and therefore the player's feeling will be maintained.

The music playing input signals SI may not necessarily be limited to the signals including some incorrectness in music theory, but may be correct in some category of music. In such a situation, if music playing signals of a particular category are inputted by the player and a conversion table for a different category of music is designated, the inputted music performance will be converted to a music performance in such a designated category style.

According to embodiments of the present invention, a play having poor musical knowledge can enjoy music playing which is correct in music theory without paying severe attention to music theory.

Further, by preparing multiplicity of chord tone distribution tables or chord note determining tables corresponding to various music categories (genres), the output performance will be the one which meets a wide variety of music categories and also makes the most of the characteristics of individual musical instruments.

While, in the above described embodiments, the inputted music playing signals are transposed to "C major" key to thereafter convert individual notes to musically correct notes, such transposition can be dispensed with by preparing note conversion tables for every key to process directly the inputted note numbers per se. Another alternative will be that note conversion tables are prepared for some of the keys (i.e. not all the keys) and the transposition will be conducted to the table of the nearest key from the designated key.

The assistive music playing apparatus 1 may not necessarily be limited to the form of an electronic musical instrument, but may be applied to a karaoke apparatus, a game machine, a portable communication terminal such as a cellular phone and a player piano. Where the invention is applied to a portable (mobile) communication terminal, a terminal may be of a self-contained type containing entire functions or may be a part of the system to cooperate with a server computer so that the system as a whole realizes the functions of the present invention.

When the present invention is embodied in the form of an electronic musical instrument, the form may not necessarily be of a keyboard instrument type, but may be of a string instrument type, a wind instrument type, a percussion instrument type, etc. The tone generator unit, the automatic accompaniment unit, and so forth may not necessarily be integrated in a single console of an electronic musical instrument, but may be individually separate ones and interconnected together by any communication means such as MIDI cables and various networks to configure the whole system.

The system according to the invention may be realized by a general-purpose computer installing the computer programs to establish the processing and operation of the above mentioned embodiments. In such a situation, the computer programs can be provided to the users in the form of a computer readable medium such as a CD-ROM and a flexible disk.

Although the invention has been described in connection with particular embodiments herein above, the invention is not limited to the described embodiments. It will be apparent to those having ordinary skill in the art that various modifications, improvements and combinations will be made without departing from the spirit of the invention.

Input Note Conversion System

The system according to the present invention is considered to be an assistive music playing system as viewed from an aspect of user's music playing as described above. But as viewed from an aspect of musical data processing, the system can be defined as an input note conversion system. Description will be now made herein below about an input note conversion system which is the above described assistive music playing system including improvements in a data processing aspect.

FIG. 8 is a block diagram showing a hardware configuration of an input note conversion system as an embodiment of the present invention. An example of the system utilizes an electronic musical instrument incorporating an automatic music performance function having a hardware configuration as illustrated in FIG. 8 to constitute a musical information processing apparatus (input note conversion apparatus). The input note conversion system of FIG. 8 is a kind of simplified form of the system of FIG. 1, and is essentially the same as FIG. 1. The structure of FIG. 8 will now be described, although there may be some redundant explanation in view of FIG. 1. The input note conversion apparatus comprises a CPU (central processing unit) 31, a ROM (read-only memory) 32, a RAM (random access memory) 33, an external storage device 34, a music playing control unit 35, a panel control unit 36, a display circuit 37, a tone generator unit 38, a communication interface 39, all of which are interconnected together by a bus 40.

The CPU 31 executes various musical information processing including input note conversion processing according to the predetermined software programs on the system clock pulses from the system timer (not shown). In the input note conversion processing, the CPU 31 functions as a sequencer module and a note conversion module. The ROM 32 stores various control programs for conducting musical information processing including the input note conversion processing, and the chord progression data and the note conversion table. The RAM 33 is used for work area for temporarily store various data and parameters necessary for the processing, for example, the data relating to input notes based on the user's music playing and output notes being produced.

The external storage device 34 includes storage media such as a hard disk (HD), a compact disk read-only memory (CD-ROM), a flexible disk (FD), a magneto-optical (MO) disk, a digital versatile disk (DVD) and a semiconductor memory to store the input note conversion program, the chord progression data, note conversion tables, etc. for use in this system.

The music playing control unit 35 is, for example, comprised of music playing controls and a music playing input detecting circuit, and processes the input note signals derived from the user's music playing manipulations of the music playing controls through the music playing input detecting circuit to introduce input note data into the system. The embodiment described below employs a keyboard for the music playing controls, and the music playing control unit 35 is referred to as "keyboard unit." The keyboard may be divided into, for example, three sub-ranges by two split points ("lower split point" and "upper split point"), which are termed as a bass range, a chord rang and a melody range from the lower end to the upper end, respectively to use for a bass performance, a chord performance and a melody performance. The music playing controls may not necessarily be limited to keys of a keyboard, but may be any arbitrary type of keys, levers on buttons according to the type (string, wind, etc.) of the musical instrument which the user will play.

The panel control unit 36 is, for example, comprised of panel controls and a control detecting circuit, and detects the contents of setting operations and controlling operations by means of the panel controls through the control detecting circuit to introduce control data into the system. The embodiment employs controls in the form of keys, levers, switches, buttons, etc., which are used to set operating conditions of the system and to input various necessary parameters or information for the input note conversion.

The display circuit 37 controls the exhibited contents on the screen of the display device (CRT, LCD, etc.) 41 or the on/off states of various indicators (lamps) according to the instructions from the CPU 31 to give the user visual aids in manipulating the controls 35 and 36.

The tone generator 38 includes tone modules and effect-imparting DSPs to generate musical tone signals as defined by the note data as obtained by converting the inputted notes, the chord progression data and the voice (tone color) data. A sound system 42 which is connected to the tone generator 38 includes a digital-to-analog converter, an amplifier and a loudspeaker, and emits audible musical sounds in the air based on the tone signals. Namely, the tone generator 38 and the sound system 42 constitutes a musical tone creating unit which produces musical tones based on the output note data as processed by the input note conversion system, voice data and the chord progression data.

To the communication interface 39 is connected an external apparatus 43 (e.g. a personal computer) having functions of processing musical data to receive various musical data including the chord progression data and control programs from the external apparatus 43.

The input note conversion system may not necessarily be limited to a dedicated musical data processing apparatus such as the above described electronic musical instrument which is particularly adapted for the musical data processing, but may be realized in the form of "a personal computer+application software" using a personal computer (PC) equipped with music playing input device such as a keyboard and with a tone generator.

Input Note Conversion Processing #1

The input note conversion system according to an embodiment of the present invention is capable of converting notes inputted by musical playing to notes which will better fit the chords and the playing conditions (arpeggio and block chord) through a note conversion processing #1 (first type input note conversion processing) called "key-on processing." FIG. 9 is a block diagram illustrating a module configuration of an input note conversion system according to an embodiment of the present invention to describe the outline of a note conversion function in a first fashion.

The input note conversion procedure of the fashion #1 will be described with reference to FIG. 9. In this input note conversion system, when the note conversion module NC receives chord information and input note information NTi from the keyboard module 35 and the sequencer module SQ, respectively, the note conversion module NC converts the note numbers (note pitches) in the input note information NTi to note numbers which will fit the chord type in the chord information using a note conversion table (TB of FIG. 10) which contains available note identifying information according to the simultaneously inputted notes with respect to each chord type, and outputs the converted note numbers as output note information NTo to the tone generator module TG. In such a circumstance, some of the note numbers for the output note information NTo are controlled in the direction of note pitch variation from the preceding input note information (NTio) to the current input note information (NTi) so that the note numbers in the output note information will not overlap with the currently sounding note. Further, the playing condition (way or manner) is detected from the input note information NTi, and the note numbers are checked and controlled so that the output note information of the note which overlaps with the note in the currently sounding note information will not be outputted to the tone generator TG in different methods according to the detected playing conditions.

The keyboard module (music playing controls) 35 produces, as the input note information, note data (key-on note number) NTi in response to the on/off actuation of the keys in the keyboard. The sequencer module SQ produces chord data for the progression of a music piece based on the chord progression data read out from the ROM 32 or the external storage device 34. The note data NTi from the keyboard and the chord data for the progression of a music piece are inputted to the note conversion module NC.

The note conversion module NC conducts a key-on processing which converts the input note data NTi to output note data NTo based on the current chord information and the predetermined conversion rule, so that the output note data NTo obtained by this key-on processing is outputted to the tone generator modulo TG (tone generator 38).

In the key-on processing, the note conversion module NC also acquires from the system timer ST key-on time data representing the time of the key-on of the note data NTi with reference to the system clock in the system timer ST. This time data acquisition is necessary for the judgment about whether the block chord playing or the arpeggio chord playing in the chord range of the keyboard as explained herein later, in which the current key-on time is within a predetermined time length (e.g. 80 ms) from the preceding detected key-on time is deemed to be a concurrent depression for a block chord, and when "not within" is deemed to be a successive depression for an arpeggio chord.

(Note Conversion Table)

The input note conversion system according to an embodiment of the present invention uses note conversion tables as a method of realizing a desirable note conversion in the key-on processing. FIG. 10 illustrates an example of the note conversion table TB to be used in the note conversion in the embodiment.

The note conversion table TB indicates the priority orders of the note identifying data to identify the note in accordance with the chord rule with respect to the respective chord types, so that numbers of notes to be generated can be varied according to the number of concurrently depressed keys. In FIG. 10, the note identifying data is defined by the distance from the chord root (root note of the chord). The table shows priority orders ("1" through "4" in the table) of the respective notes expressed in distance depending on the number of simultaneously depressed keys with respect to each of the chord types (Major, M7, M6---) listed in the leftmost column, and tells the note names (=numbers) of the available notes in connection with the simultaneously depressed keys.

The distances from the chord root are expressed by "0" through "11" in semitone as shown in the top row of the table. For example, for the C major chord whose root note is "C," the note names "C" through "B" correspond to "0" through "11," respectively. The numeral "1" or above indicates the note of that column can be used for the note conversion up to the number of simultaneously depressed keys. The numeral "0" indicates that the note of that column cannot be used.

More particularly, the numeral "1" and above indicate the order of priority in use for note conversion within the number of simultaneously depressed keys. The greatest numeral in each row (e.g. "3" in the row of C major) shows the maximum number of concurrently available notes. For example, if the number of simultaneously depressed keys is "2," the notes assigned with "1" and "2" can be used it the note conversion. Further for example, when the note name F#5 is inputted as the note data NTi on the C major chord where the number of simultaneously depressed key is one, the note "E" (distance="4") assigned with "1" is picked up and the erroneously depressed key of "F#5" is converted to "E5." But where the number of simultaneously depressed keys is two, the closer of "1" and "2" to the note "F#" (distance="6") is "G" (distance="7") having the priority order of "2," and therefore the "G" is employed, and consequently the note "F#5" is converted to the note "G5."

In the case where no chord information is inputted or the setting to neglect the chord information is made, i.e. where no chord information is to be used in connection with the note conversion, the chord type is instructed to be "Cancel." In the row of "Cancel," all the notes (i.e. distances) are assigned with numeral "1," and this means that when the "Cancel" is instructed, any input note data NTi per se will be outputted as data NTo, and no note conversion takes place.

There may be prepared different note conversion tables in accordance with the key ranges and the white/black key distinction (in terms of C major). For example, where the keyboard is divided into three sub-ranges: a bass key range, a chord key range and a melody key range, six tables are prepared (6=3 key ranges×2 key distinctions). By preparing a plurality of different tables, different conversion rules can be applied to establish more musically sophisticated music playing.

(Prevention of the Same or a Close Note Pitches)

The key-on processing according to an embodiment of the present invention employs a solution for the troubles in the case where the converted note becomes the same note as or the close note to the currently sounding note thereby causing overlap of notes. One way of avoiding overlaps is to employ different methods in note conversion depending on the key ranges (bass, chord and melody ranges) and the playing conditions (arpeggio and block). For example, when the converted note is the same as or close to the currently sounding note, there can be two ways of solution. Namely, 1) No note is generated for the converted note,
2) Search for next candidate (utilizing note conversion tables).

Which way to take can be predetermined with respect to the key ranges and the playing conditions. For example, in the bass range, no note is generated for the converted note. In the chord range and for the arpeggio playing, a next candidate will be searched for. In the chord range and for the block chord playing, no note will be generated for the converted note. In the melody range, a next candidate will be searched for.

In detecting overlapping notes (including both same and close pitches), it is musically preferable to set the detection allowance (i.e. width, the interval limit) of note pitch to judge the overlaps wider for lower notes, and therefore it is preferable to set the interval limits differently for the note pitch sub-ranges (bass, chord, melody). Further, the interval limits may be set differently between the stem notes (white keys in the scale of C major) and the accidental notes (black keys in the scale of C major) to obtain different conversion characteristics between the stem notes and the accidental notes. For example, the input of an accidental note (sharp or flat note) may well probably be an intentional input as a tension note rather than an erroneous depression of the key. For example, the interval limit are set to be "0" for the note conversion factors to permit every note of the depressed key is not converted but is generated per se.

When the keys are depressed in the chord key range (middle key range), the time difference between the two successive depressions of keys will be used in judging whether the inputted key depressions are for the arpeggio performance or for the block chord performance. For example, when the time difference of the current key-on time with respect to the preceding key-on time falls within a predetermined amount, such key-on events are considered to be for a block chord, and when the time difference of the current key-on time with respect to the preceding key-on time exceeds the predetermined amount, such key-on events are considered to be for an arpeggio performance, and the information is recorded accordingly. The preceding key-on time as the comparison reference is the time of the note event of the actually sounding note or the time of the note event of the note to be sounded. When a new note generation is done or is to be done, the preceding key-on time is renewed. The predetermined amount may be set by the user as a constant value, and may be varied in accordance with the tempo of the music being played.

In searching for the next note candidate to avoid overlap, it is difficult to anticipate whether the new selected note will be above the preceding key depression or below. Namely, where the phrase is ascending and the converted note happens to come below the preceding note, or vice versa, there may arise an unnaturalness. In an embodiment, therefore, whether the search for the next candidate is to be made above or below the converted note is determined based on the comparison with the note number (NTio) of the preceding key depression. If the current key-on note number NTi is lower than the preceding key-on note number, the search will be conducted downward, and if higher, the search will be conducted upward. If the current key-on note number NTi is the same as the preceding key-on note number, the search direction may be maintained or may be determined either upward or downward. By determining the searching direction in the method as explained above, there will not occur a reversal in the note movement after the note conversion as compared with the actual key depressions in an ascending phrase or a descending phrase.

(Key-On Event Processing)

FIGS. 11 and 12, in combination, illustrate a flow chart of a key-on event processing according to an embodiment of the present invention. In these Figures, rectangular blocks and hexagonal blocks tagged with symbols S1 through S10 represent process steps as indicated by the attached legends, respectively, and solid line arrows show flows between the steps. Corner-rounded rectangular blocks represent information (data contents) and broken line arrows indicate the use of the respective information. This embodiment of the processing utilizes note conversion tables selectively from among a plurality of tables prepared.

First, a step S1 judges whether each of the inputted key-on note numbers NTi is of a white key or of a black key as viewed in the normalized C Major key (or a stem note or an accidental note as viewed in the source key). A step S2 judges the key range and renew (overwrite) the key range information, and also renew the number of simultaneously depressed keys in the key range and the interval limit value. The interval limit value is set to be "4" semitones in the bass key range, "1" semitone in the chord key range, and "0" (no consideration) for the melody key range. When the chord type is designated as "Cancel," the interval limit value is always "0."

Next, a step S3 determines a conversion table to be used for the note conversion based on the key range and the category, and then a step S4 derives converted note numbers NTc based on the determined conversion table TB, the chord information and the number of the simultaneously depressed keys. A step S5 then check overlapping in the converted note numbers NTc with reference to the interval limit value and current note information.

When the step S5 judges there is no overlap in the note numbers, the process moves forward to a step S6 to substitute the converted note number NTc to the output note number NTo and conducts the tone generation processing. After the tone generation processing, the converted note number NTc is substituted for the current note information (FIG. 11), the preceding depressed keys NTio is renewed by the output note number NTo (FIG. 12), the preceding key-on time is renewed by the key-on time of the output note number NTo (same as the key-on time of the key-on note number NTi) (FIG. 12), when the key range of the note number NTc as processed for tone generation is the chord key range. That is, every time the tone generation processing is conducted, the current note information (note number) is renewed, and in the case of the chord key range, the preceding key-on time is also renewed.

On the other hand, when there is an overlap in the note numbers, the process moves forward from the step S5 to a step S7 (FIG. 11) to conduct the following overlap avoid processing (FIG. 12). In the overlap avoid processing, the step S7 recognizes the key range (whether melody range or chord range) and the playing condition (whether arpeggio or block). The process of recognizing the key range and the playing condition (S7) first recognizes the key range with reference to the key range information, and in the case of the chord range, judges whether the arpeggio playing or the block chord playing from the time difference between the current key-on time and the preceding key-on time, and determines whether to generate the note NTc which overlaps with the preceding note or to search for the next candidate note number in accordance with the recognized playing condition in the case of the chord key range or other key range information (bass range or melody range).

When the step S7 recognizes that the input note events are in the bass range or a block chord in the chord range, the process flow goes to a step S8 to generate no tones for the note number NTc. The block chord is defined to be the condition (state) where a plurality of keys are depressed simultaneously or substantially simultaneously. Where the chord type is "cancel," it may be considered that there is no overlap. Even in the case where the step S8 determines to generate no tones, the preceding depressed keys NTio is renewed by the current NTio. In other word, whether the tone is to be generated (S6 in FIG. 11) or not to be generated (S8 in FIG. 12), the data of the preceding depressed keys NTio will be renewed.

On the other hand, when the step S7 recognizes that the key events are in the melody key range or of the arpeggio playing in the chord range, process flow proceeds to a step S9 to search upward/downward for the next note candidate. The arpeggio playing is defined, for example, herein, as the case where the current note event has occurred more than 80 milliseconds apart from the preceding note event. In order to search for the next candidate, the current key-on note number NTi is compared with the preceding depressed key NTio to determine whether to search upward or downward in order to maintain the note pitch travel direction.

Next, a step S10 renews the key-on note number NTi by incrementing or decrementing the key-on note number NTi by "+1" or "−1" to obtain the renewed key-on note number NTi', and further convert the renewed key-on note number NTi' to derive a new converted note number NTc at the step S4 (FIG. 11).

The new converted note number NTc is then subjected to the overlap check at the step S5 (FIG. 11). These steps of the upward/downward search (S9), the key-on note number renewal (S10), the note conversion (S4) and the overlap check (S5) are repeated in a loop until a note number which does not overlap with another existing note number is found. When a non-overlapping note number is found, the process goes forward to the step S6 for the tone generation processing.

The above described key-on event processing will be specifically explained in detail using the following two examples.

EXAMPLE 1

The Case where the Chord is "C Major" and the Keys are Depressed in the Melody Key Range 1) It is assumed that the user plays (i.e. depresses) "A5" note in the melody key range initially and that there is no other notes are played. The "A5" note is the only one input note at this moment.

1a) The row of "Major" in the note conversion table of FIG. 10 is referred to (looked up) to find the priority order of "1." The note having this priority order "1" is "E" note. Thus, the input note "A5" (NTc) is converted to note "E5" (NTc). The note "E5" is immediately outputted as the output note information NTo, which is now the current note information, and the played input note "A5" is the preceding depressed key NTio (through S4, S5 and S6).

2) It is then assumed that the user plays the second note "F5" in the melody key range, while the "E5" note is being generated (for "A5" depression).

2a) As the "F5" note is the second note for simultaneous generation, the row of "Major" in the table gives two priorities "1" and "2" which respectively indicate the "E" note and the "G" note for the input note NTi of "F5," and the step S4 selects the "E" note which is the closer of the two to the input "F" and outputs the note number (i.e. note name) of "E5" as a candidate of the converted note number NTc.

2b) As the "E5" note is being generated, the step S5 (FIG. 11) checks overlapping to find the overlap of note numbers.

2c) As the key range is the "melody range," the step S7 (FIG. 12) recognizes the key range to direct the process flow to the step S9 for searching the next candidate. Where the preceding depressed key NTio is "A5" which is higher than the depressed second note "F5" (F5<A5), the step S10 subtracts "1" from the key-on note number NTi to produce an "E5" note as a converted key-on note number NTi'. The step S4 (FIG. 11) refers to the note conversion table TB (FIG. 10) with the converted note number of "E5."

2d) Although the note conversion table TB (FIG. 10) affirms the "E5" note with the first priority, the step S5 checks the overlap of the notes, and the process flow passes through the steps S7 and S9, and the step S10 again subtracts "1" from the converted key-on note number NTi'. These process steps are repeated in loop as explained in 2a) through 2c) above.

2e) When the converted note number NTi' becomes "B4," the table TB shows "G" note with the priority "2" near the converted note number "B4." Thus, the "G4" note is selected as a candidate converted note number NTc. This "G4" note does not overlap with another note, and therefore is outputted as NTo for the tone generation processing.

3) It is further assumed that the player releases the first key "A5," keeps on depressing the second key "F5" (the note being generated is "G5") and depresses the third key "B5" anew.

3a) As two keys are being depressed (two input notes), the table TB presents "E" and "G" as available notes, among which the note "G" which is closer to "B" is employed, and the note "G5" is outputted as a converted note number NTc at the step S4.

3b) As the note which is being generated at this moment is "G4," the step S5 does not find overlap of notes, and the note "G5" is outputted as an output note NTo for the tone generation at the step S6.

EXAMPLE 2

The Case where the Chord "GM7" (G Major Seventh) is Played in the Chord Key Range 1) It is assumed that the user plays (i.e. depresses) "F3" key (NTi) in the chord key range, while there is no other keys being depressed and there is no preceding key-on time stored.

1a) For this single key depression, the table TB shows in the row of "M7" the first priority "1" at the note distance "11" (this note is "B" for the root of "C," but "F#" for the root of "G") and then the note "F#3" is outputted as a converted note NTc and in turn as an output note NTo via the steps S4-S6. The current note information is NTo, i.e. "F#3."

1b) After the note "F#3" is generated, the key-on time of the actually depressed key "F3" is stored as the preceding key-on time, and also "F3" is stored as the preceding depressed key.

2) It is then assumed that the user further depress the key "E3" in the chord key range almost simultaneously (i.e. with a time difference less than 80 ms) with the key "F3."

2a) The first and the second priority "1" and "2" in the row of "M7" shows the note distances "11" and "4." As the played key "E3" corresponds to the note distance "9" for the root of "G," the selected note from the table TB will be the note distance "11" and then the note "F#3" (i.e. the note distance "11" for the root of "G") is outputted as a candidate of a converted note NTc at the step S4.

2b) As the note "F#3" is now being generated, the step S5 judges that there is an overlap of notes, and next the step S7 recognizes a block chord (the playing condition) in the chord key range (the key range). The step S8 decides to generate no tones but renew the preceding depressed key NTio by "E3." (The preceding key-on time is not renewed.)

3) While the "F3" key is being depressed, the user plays the "C3" key in the chord key range a little (e.g. 100 ms) after the "F3" depression.

3a) The played key "C3" corresponds to the note distance "5" for the root of "G," and among the two priorities "1" and "2" in the row of "M7" the table TB presents two available notes at the note distances "11" and "4." The closer of the two to the note distance "5" is "4," and then the note "B2" (i.e. the note distance "4" for the root of "G") is outputted as a candidate of a converted note NTc at the step S4.

3b) As the note "B2" does not overlap with the preceding note under generation, the step S5 directs the process flow to the step S6 for the tone generation processing, and this "B2" is added to the current note information, and the preceding key-on time is renewed by the key-on time of the key "C3," and the preceding depressed key NTio is renewed by the depressed key "C3."

4) While the "F3" key and the "C3" key are both kept depressed, user further plays the "G3" key in the chord key range a little (e.g. 100 ms) after the "C3" depression.

4a) The row of "M7" in the table TB presents three priorities "11," "4" and "7" as the available note distances. As the now-played key "G3" corresponds to the note distance "0" for the root of "G," the note distance "11" is selected as being nearest to the note distance "0" and accordingly the note "F#3" is outputted as a candidate NTc at the step S4.

4b) As the note "F#3" is now being generated as the first played note, and therefore the candidate output of "F#3" overlaps with the note under generation, and the step S5 directs the process flow to the step S7 for the recognition of the arpeggio playing in the chord key range. The step S9 conducts search upward or downward.

4c) As the current played key "G3" is higher than the preceding depressed key "C3" (NTio), the key-on number NTi will be successively renewed by "+1" every time the process flow loops the steps through S9, S10, S4 and S5 until the table TB presents a converted note number NTc which does not overlap with another generated note.

4d) When the converted note number NTi' becomes "A3" which is the note distance of "2," the note distance "4" becomes closest to "2," and accordingly the note "B3" is selected as the candidate note NTc, and the step S5 judges there is no overlap and directs the process flow to the step S6 for the tone generation. The output note number NTo is now "B3" and is supplied to the current note information for renewal.

(Modifications of Input Note Conversion Processing #1)

While preferred embodiments of the input note conversion processing #1 as conducted in the input note conversion system of the present invention have been described with reference to the associated drawings, various modifications will be possible without departing from the spirit of the present invention so that the present invention can be practiced in various forms. For example, the note conversion table may be of a type having plural sub-tables to be used in various combinations, and also may be subjectable to edition, and may comprise many kinds of sub-tables. In the described embodiments, the candidate note numbers are searched with consideration to the number of simultaneously inputted notes (keys) when referring to the tables, but the table may be prepared individually for the respective number of simultaneously depressed keys.

The distance at which plural simultaneous note generation is prohibited (allowance for overlap detection) may be arbitrarily set by the user, or may be factory-set as a default setting (fixed), or may be commonly provided through the entire key range. For the keys in the same key range, the prohibition distance may be set different between white keys and black keys (stem note keys and accidental note keys).

The distance at which plural note generation should be avoided may be determined based on the low interval limit (the frequency or note pitch below which two tones of close frequencies sound mumbling with their harmonics interfering with each other). For example, in the case of two notes separated by a major second interval, the low interval limit is applied below the notes "F3" (175 Hz) and "Eb3" (156 HZ). In the case of two notes separated by a minor third interval, the low interval limit is applied below the notes "Eb3" (156 Hz) and "C3" (131 Hz). In the case of major seventh interval separation, the low interval limit is applied below the notes "E3" (165 Hz) and "F2" (87 Hz).

The methods for avoiding overlap (including coincidence and close vicinity) of converted notes with the currently sounding notes are preferably different for different playing conditions for the note conversion system of the present invention. The different methods (solutions) may be, for example, to suppress tone generation, to generate notes in another octave, to replace by an adjacent chord note, and to utilize look-up tables. In the above described embodiments, the differentiation by the playing conditions is employed only in the chord key range, in which the method allotted to the arpeggio playing is to utilize tables, while the method allotted to the block chord playing is to suppress tone generation. However, in other key ranges (the melody range and the bass range) also, the detection process of music playing conditions can be employed and appropriate overlap avoiding methods can be allotted to different playing conditions. For example, in the melody key range, the method of utilizing look-up tables is allotted to the arpeggio playing, whereas the method of generating notes in another octave is allotted to the block chord playing. In the bass key range, the method of utilizing look-up tables is allotted to the arpeggio playing, whereas the method of replacing by an adjacent chord note is allotted to the block chord playing. The combinations of a playing condition and a method for searching for a candidate note are not limited to the above examples. Further, the kinds of playing conditions may be anything else than the above examples. For example, a legato performance may be so recognized when the preceding note (key) is still being inputted (depressed), that is, while the preceding key-on event is still continuing, and the next note (key) is then inputted (depressed) some amount of time (e.g. more than 0.5 s) after the preceding key-on time. When the chord type is designated as "Cancel," no overlap check takes place before tone generation.

The key range division may not necessarily be as described above, but may be otherwise such as dividing into two ranges: a melody key range and a chord key range.

The time differences for recognizing the playing conditions (styles) may be arbitrarily set by the user, or may be factory-set at default values. In place of the milli-second counting, time length may be counted on the basis of music progressing tempo (e.g. 16th note duration and 8th note duration).

The chord information to be applied to a piece of music to be played is not limited to one set (series) of chord progression, but may be provided in plural sets. The chord information may be previously stored in the apparatus as explained above, and also may be inputted real time.

With respect to the chord information, the processing system may have a function of recognizing chord functions and may chose different methods of note conversion (table utilization or else) according to the chord functions. Then the note conversion to the notes which will meet the chord functions will be possible. Further, at the process step of overlap avoidance after the note conversion, the chord functions may be taken into consideration. In order to recognize the chord functions, the tonality key information and the chord degree information of the respective chords are necessary. The tonality key information may be provided, for example, through the user's setting with the panel controls, or by extracting from the source data (file) containing chord information. The chord degree information may be obtained through calculation based on the chord root and the tonality key given by any means, or by attaching the chord degrees in the chord information as provided.

Examples will be as follows:

(a1) In the case of Am chord in C major key: As the Am chord is the sixth degree chord (i.e. VIm) and has a function of tonic chord, an inputted note is converted to a "C" note. (The rule is: In the case of a chord having the tonic function, an inputted note is converted to the root note of the prevailing key, i.e. the key note.)

(b1) In the case of G7 chord in C major key: As the G7 chord is the fifth degree chord (i.e. V7) and has a function of a dominant chord, an inputted note is converted to a "G" note or a "B" note. (The rule is: In the case of a chord having the dominant function, an inputted note is converted to the root or third note of the chord.)

(c1) In the case of Dm chord in C major key: As the Dm chord is the second degree chord (i.e. Ilm) and has a function of a subdominant chord, an inputted note is converted to a "D" note. (The rule is: In the case of a chord having the subdominant function, an inputted note is converted to the root note of the chord.)

Examples of above cited chords but in another keys will be as follows:

(a2) In the case of Am chord in A minor key: As the Am chord is the first degree chord (Im) and has a function of tonic chord, an inputted note is converted to an "A" note.

(b2) In the case of G7 chord in G major key: As the G7 chord is the first degree chord (i.e. 17) and has a function of tonic chord, an inputted note is converted to a "G" note.

(c2) In the case of Dm chord in F major key: As the Dm chord is the sixth degree chord (i.e. VIm) and has a function of tonic chord, an inputted note is converted to an "F" note.

Examples of E major chord in various keys will be as follows:

(a3) In the case of E chord in C major key: As the E chord is the third degree chord (i.e. III) and has a function of tonic chord, an inputted note is converted to a "C" note.

(b3) In the case of E chord in A major key: As the E chord is the fifth degree chord (i.e. V) and has a function of dominant chord, an inputted note is converted to an "E" note or a "G#" note.

(c3) In the case of E chord in B major key: As the E chord is the fourth degree chord (i.e. IV) and has a function of subdominant chord, an inputted note is converted to an "E" note.

Where the chord function is to be considered in controlling the process of note overlap avoidance, an example of how to determine the converted note is as follows:

When a "G4" note is now being generated for the C major chord as provided in the chord progression under the G major key as designated by the user's setting and a first candidate of converted note is also "G4," the C major chord is the fourth degree chord (IV) and has a function of subdominant chord, an inputted note is converted to a "C" note as the root of the chord, and thus the note "C4" will be generated in place of the first candidate note "G4."

Input Note Conversion Processing #2 and #3

In an input note conversion system according to another embodiment of the present invention, the notes inputted by musical playing are converted to notes which will better fit the chords and the voices (timbres) for the music piece to be performed through a note conversion processing #2 and through a note conversion processing #3 (second type and third type input note conversion processing) called "key-on processing #2 and #3." FIG. 13 is a block diagram illustrating a module configuration of an input note conversion system according to an embodiment of the present invention to describe the outline of a note conversion function in a second and a third fashion.

According to the input note conversion processing #2 in this input note conversion system, as illustrated in FIG. 13, the input notes NTi as inputted from the keyboard 35 according to the user's actual music playing are converted by the note conversion module NC to output notes NTo which will fit the chord information supplied from the sequencer SQ, in which the key depression state (note input conditions) MC of the keyboard 35 by the user controls whether an input note is converted to a basic note or to a non-basic note. In a specific embodiment, the note conversion tables which contain note employment (deciding) factors for converting notes in compliance with the respective chord types are prepared in two types, a first type table TBa, TBb, . . . for converting to basic notes, and a second type table TBt1, . . . , TBs for converting to non-basic notes or to either of basic notes and non-basic notes, in which the type to be used is determined according to the note input conditions so that non-basic notes may be employed as converted notes depending on the note input conditions.

According to the input note conversion processing #3 in this input note conversion system, note conversion condition information is stored for each voices (timbres), and there are prepared a plurality of note conversion tables indicating note employment factors for available converted notes concerning respective chord types. Through the note conversion in this system, briefly speaking, the note conversion module NC converts the input notes NTi as inputted by the user's playing on the keyboard 35 to notes NTo which fit the chord information from the sequencer SQ using the note conversion tables, in which the voices (timbres) as designated by the voice information are taken into consideration. For example, the note conversion tables (NT, TT) are selectively utilized according to the designated voices VS, and the note numbers to be outputted as converted notes NTo using the tables are controlled to fit the designated voices VS based on the note conversion conditions (SM through RC) relating to such designated voices VS.

The embodiment will be described in more detail hereunder. Referring to FIG. 13, the keyboard module (music playing controls) 35 outputs input key-on/key-off data (key-on note numbers) NTi according to successive on/off manipulations of the keys on the keyboard 35 along with the progression of music playing, thus providing input note information. The sequencer module SQ provides chord information constituting the chord progression for the music piece to be played based on the chord progression data as read out from the ROM 32 or the external storage device 34. The note numbers NTi from the keyboard 35 and the chord information from the sequencer SQ are inputted to the note conversion module NC for the note conversion processing.

The note conversion module NC includes note conversion tables (FIGS. 15, 16*a*, 16*b* and 16*c*) listing note employment factors to be used corresponding to the respective chord types, and upon receipt of the chord information from the sequencer module SQ and the key-on note number NTi from the keyboard module 35, it looks up in the prescribed note conversion table which is selected according to the designated voice (timbre) VS and converts the inputted key-on note number NTi to an output note number NTo based on the chord information and the predetermined conversion rule, to finally outputs the note number of the output note information NTo (key-on processing #2).

In the key-on processing #2, the note numbers of the input note information NTi are converted to the note numbers which will fit the voice VS and the chord types to be outputted as the output note information NTo, in which the note conversion module NC is also controlled so that the converted note can be a note other than the basic note like a chord constituent note depending on the key depression state MC. The output note information NTo created through the key-on processing #2 is outputted to the tone generator module 38 to be finally emitted as audible sounds by the sound system 42 (FIG. 8).

(Conversion Conditions for Voices)

In the input note conversion system according to an embodiment of the present invention, the key-on processing #2 conducts the desired note conversion using conversion information indicating note conversion conditions for the respective voices (timbres) to be designated. FIG. 14 shows an example of the conversion information for voices.

The conversion information for voices is the information to indicate the conditions for the note conversion with respect to each of the voices available. Designation of the voice can be made by the user's voice selecting operation on the panel controls 36, or by extracting voice information (program change message) from the music data stored in the ROM 32 or the external storage device 34. The conversion information for voices contains, as shown in FIG. 14, for example, conversion conditions or factors with respect to various parameter items like the maximum number of simultaneously available tones SM (representing the maximum number of musical tones to be generated simultaneously), the highest note number NH and the lowest note number NL (representing the upper and the lower limit of the note range for the output note information NTo), the playing condition RC (representing conditions peculiarly dependent on the voices according to the manners of playing so-named instruments), and the normal table NT and the tension table TT (representing the tables to be looked up among the normal note conversion tables TBa, TBb, . . . and the tension note conversion tables TBt1, TBt2, . . . ) with respect to various instrumental voices VS (including guitar, soprano recorder, violin, piano, etc.).

The maximum number of simultaneously available tones SM is used to limit, within this value, the number of tones to be generated simultaneously by the musical tone producing section 38 and 42 in connection with the number of simultaneously depressed keys on the keyboard 35, and the highest and the lowest note number NH and NL are used to limit the note numbers for the tones to be generated within the note range represented by these note numbers NH through NL depending on the designated voice.

The playing condition RC is information representing conditions according to the manners of playing so-named instruments as identified by the voice names. For example, in the case of a string instrument, there is peculiar conditions that all of the simultaneously generated notes should be assigned to individual strings in one note to one string correspondence and that all the frets to be pressed should be reached by the fingers of one hand (usually, left hand), and in the case of a piano, there is also peculiar conditions that all of the simultaneously generated notes should be of the keys reached by the right and the left hand and also that the finger travelling for successive keys are actually possible by the right and the left hand. The table shown in FIG. 14 says in the guitar voice that all the notes (maximum is "6," i.e. SM=6) to be generated should be shared among six strings individually without an overlap.

In the input note conversion system according to an embodiment of the present invention, the key-on processing #2 uses note conversion tables to realize the desired note conversion, in which the example of FIG. 14 uses two kinds of note conversion tables called normal note conversion tables NT and tension note conversion tables TT to obtain converted note numbers of the basic notes and the tension notes corresponding to the key depression state (which keys are played). For this purpose, there are prepared a plurality of normal conversion tables TBa, TBb, . . . and a plurality of tension conversion tables TBt1, TBt2, . . . , among which a particular normal conversion table or a particular tension conversion table is selectively designated according to the voice designated for the playing output. The normal table information NT and the tension table information TT are information to designate the normal table and the tension table to be set (used) according to the voice to be used, and for example, designate tables in terms of table numbers.

(Note Conversion Table)

Some examples of the note conversion tables are shown in FIGS. 15, 16*a*, 16*b* and 16*c*. According to the conversion parameter condition table of FIG. 14, a guitar voice of this example in the first column of the voice kinds designates a normal conversion table TBa of FIG. 15 with respect to the parameter of normal table NT for the note conversion of basic notes and designates a tension conversion table TBt1 of FIG. 16*b* with respect to the parameter of tension table TT for the note conversion of tension imparting note. A recorder (soprano) voice in the second column of the voice kinds designates a normal conversion table TBb of FIG. 16*a* with respect to the parameter of normal table NT and a tension conversion table TBt1 of FIG. 16*b* with respect to the parameter of tension table TT.

The note conversion table lists availability factors of the respective notes in terms of distances from the chord root note with respect to the respective chord types in converting the notes NTi of the note information as inputted by the user (e.g. from the keyboard) to acceptable notes NTc. In FIGS. 15, 16*a*, 16*b* and 16*c*, the availability factors are represented by particular predetermined numerals for the respective note distances from the chord root with respect to the respective chord types in a matrix form, in which the numeral "0" indicates that the note of the distance on this column is not available for a converted note, and numerals "1" or else indicate that the note of the distance on this column is available for a converted note. The values of the numerals mean the priority orders to be employed when a number of keys are simultaneously depressed (i.e. plural notes are inputted simultaneously). For example, when there are three simultaneous input notes, the note distances designated by the priority orders of "3" or less are available for the converted note, i.e. may be outputted as a converted notes. The availability factors are also termed here as "note employment factors."

To describe more specifically, for example, with respect to FIG. 15, the notes are represented in terms of the distances from the root of the chord using numerals "0" through "11" (twelve notes in an octave), and respectively correspond to the note names "C" through "B" as aligned under the heading of "Note Names for Root of C." The note names are omitted from illustration in FIGS. 16*a*, 16*b* and 16*c*. The numerals "1" or more indicates the notes which can be used for converted notes, with respect to the types of chords of Major (a major chord), M7 (a major seventh chord), M6 (a major sixth chord), and so forth. In looking up the table, find a factor of "1" or more (but not more than the number of simultaneously inputted notes) that is closest to the input note NTi in the row of the designated chord type (current chord type) and employ such a found note as a converted note NTc.

In case the chord information is not utilized, for example, by not inputting chord information or by setting chord negligence designation, the chord type is indicated as "Cancel" and the factors in the bottom row are applied, i.e. "1" for all note distances. When the "Cancel" is designated, every inputted key-on note number NTi itself will be the converted output note number NTo, which means no conversion takes place onto the inputted note number.

By providing a number of different types of note conversion tables based on the similar principle, different conversion rules can be applied to the input notes. For example, the inputted notes on an ordinary performance (music playing) can be converted to chord constituent notes by using a note conversion table as labeled "Normal Note Conversion Table" such as exemplified in FIGS. 15 and 16*a*. Further, particular ones in the inputted notes can be converted to tension notes for the particular chord by using a note conversion table as labeled "Tension Note Conversion Table" such as exemplified in FIG. 16*b*.

The normal note conversion table TBa shown in FIG. 15 is an example of a normal note conversion table in which the priority orders of the notes to be employed are placed in a certain pattern for the case of plural keys depressed simultaneously so that the notes having the priority orders which is equal to or less than the number of simultaneously depressed keys are available for the note conversion, while the notes having the numeral "0" should not be used for the note conversion. The numerals of the note employment factors are assigned to the available number of converted notes in the case a number of keys are depressed simultaneously, and each of the numerals indicates the priority order of each available note according to the number of simultaneously depressed keys. The maximum number in each row (e.g. "3" in the row of "Major") indicates the maximum number of notes to be generated for the chord type. It should be understood that the notes to be generated and the notes not to be generated are variously determined depending on the number of simultaneously depressed keys.

For example, in case the number of simultaneously depressed key is "2," the notes having the priority order "1" and "2" can be employed as the converted notes. In case the note "F#5" is inputted as the key-on note number NTi over the C major chord, if the number of simultaneously depressed keys is "1," the note "E" (distance is "4") having the priority order "1" is immediately retrieved and the inputted note "F#5" is converted to the note "E5," but if the number of simultaneously depressed keys is "2," the available notes are "E" and "G" respectively having the priority orders "1" and "2," and the note "G" (distance is "7") having the priority order "2" and being closer to the inputted note "F#" (distance is "6") is retrieved, and thus the inputted note "F#5" is converted to the note "G5."

The normal note conversion table TBb shown in FIG. 16*a* is another example of a normal note conversion table in which only numerals "1" are placed at the available notes without indicating the priority orders. The normal conversion table having employment factors in this pattern are suitable for use in the case of a voice such as a recorder which can generate only one note at a time.

The tension note conversion table TBt1 shown in FIG. 16*b* is an example of a tension note conversion table in which only numerals "1" are placed at the available notes. This tension note conversion table TBt1 is used to retrieve a tension note for the chord according to the note employment factor "1" based on the note input information under a particular music playing conditions, and in reality is used together with a normal note conversion table. For example, the two tables designated by the table information (parameters) in the table of FIG. 14 will be selectively used in the following manners:

(Ex. 1) The normal note conversion table is applied to the note conversion of the input information from the white key manipulation, while the tension note conversion table is applied to the note conversion of the input information from the black key manipulation.

(Ex. 2) The normal note conversion table is applied to the note conversion of the input information up to the predetermined number of simultaneously depressed keys, while the tension note conversion table is applied to the note conversion of the input information beyond that predetermined number of simultaneously depressed keys.

(Ex. 3) The normal note conversion table is applied to the note conversion of the input information, if the input key-on event is more than a predetermined time length (e.g. 100 ms) after the preceding key-on event, while the tension note conversion table is applied to the note conversion of the input information, if the input key-event is within this predetermined time length from the predetermined key-on event.

In the case of above (Ex. 2), in which the inputted notes are converted to the chord constituent notes up to the predetermined number of simultaneously depressed keys, and the inputted notes are converted to the notes including non-chord constituent notes, a single table can be prepared and used. The overall note conversion table TBs of FIG. 16*c* is an example of a table which can be used in such a case. This table TBs contains note employment factors in the pattern of priority orders corresponding to the number of simultaneously depressed keys "1" through "6" as in the table TBa of FIG. 15, in which the notes having the priority orders of numerals (other than "0") equal to or less than the number of simultaneously depressed keys can be employed for the output converted notes.

According to this overall note conversion table TBs, if the chord is C major and the number of simultaneously depressed keys is constantly "3," the three inputted notes are converted to the chord constituent notes (basic notes) of "C," "E" and "G." However, if the number of simultaneously inputted notes exceeds "3" (i.e. "3" <the number of simultaneously inputted notes <the maximum number of simultaneously available notes SM="6"), the inputted notes are converted to the notes among the three chord constituent notes "C," "E" and "G" plus a number of non-chord constituent notes "B," "D" and "A" having the priority orders within the number of simultaneously inputted notes. In this case, the inputted notes may be converted to any of the basic notes, or may be converted to any of the non-basic notes, depending on the conditions.

(Key-on Event Processing #2)

Figure 17A:
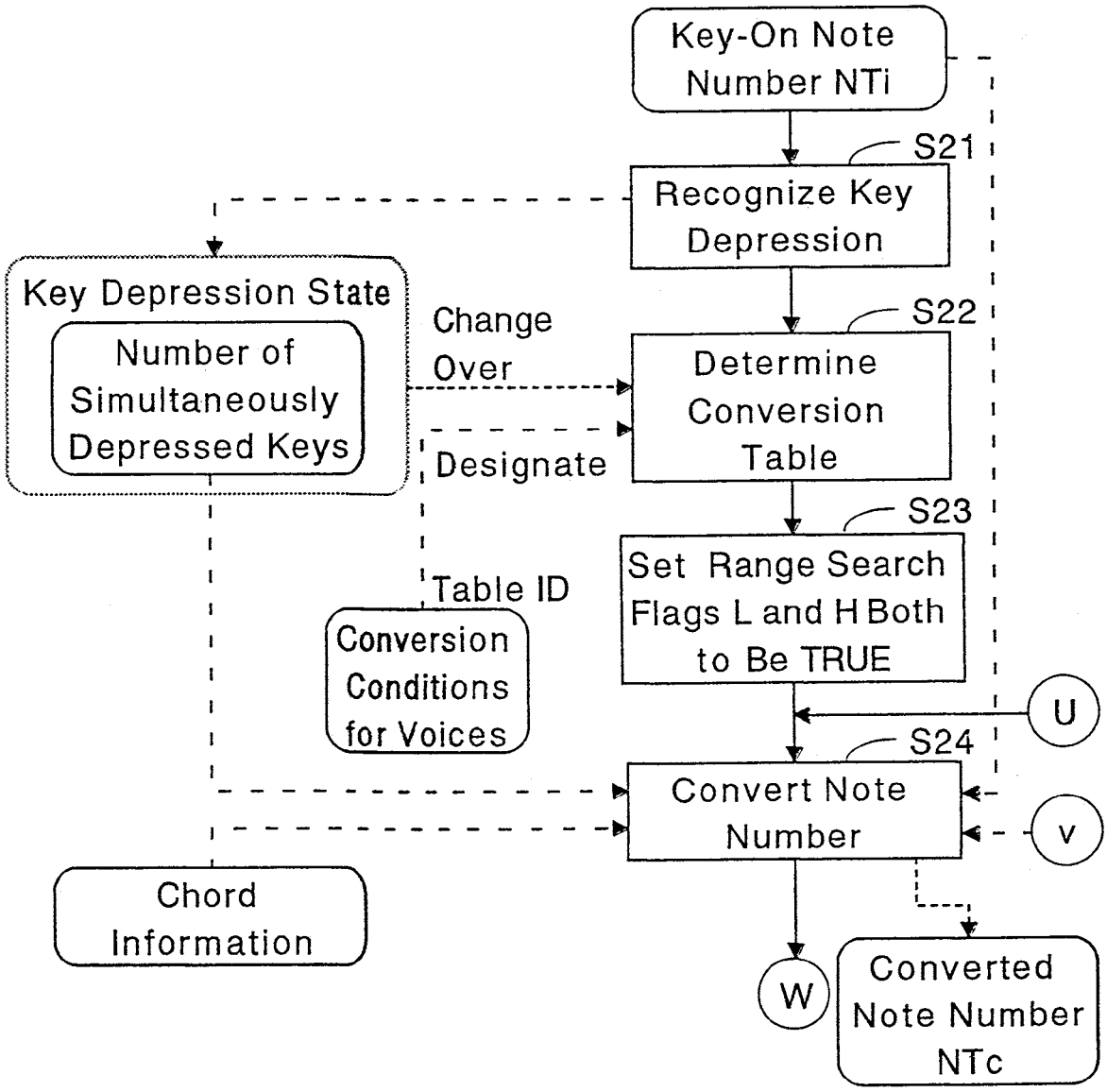
Figure 17B:
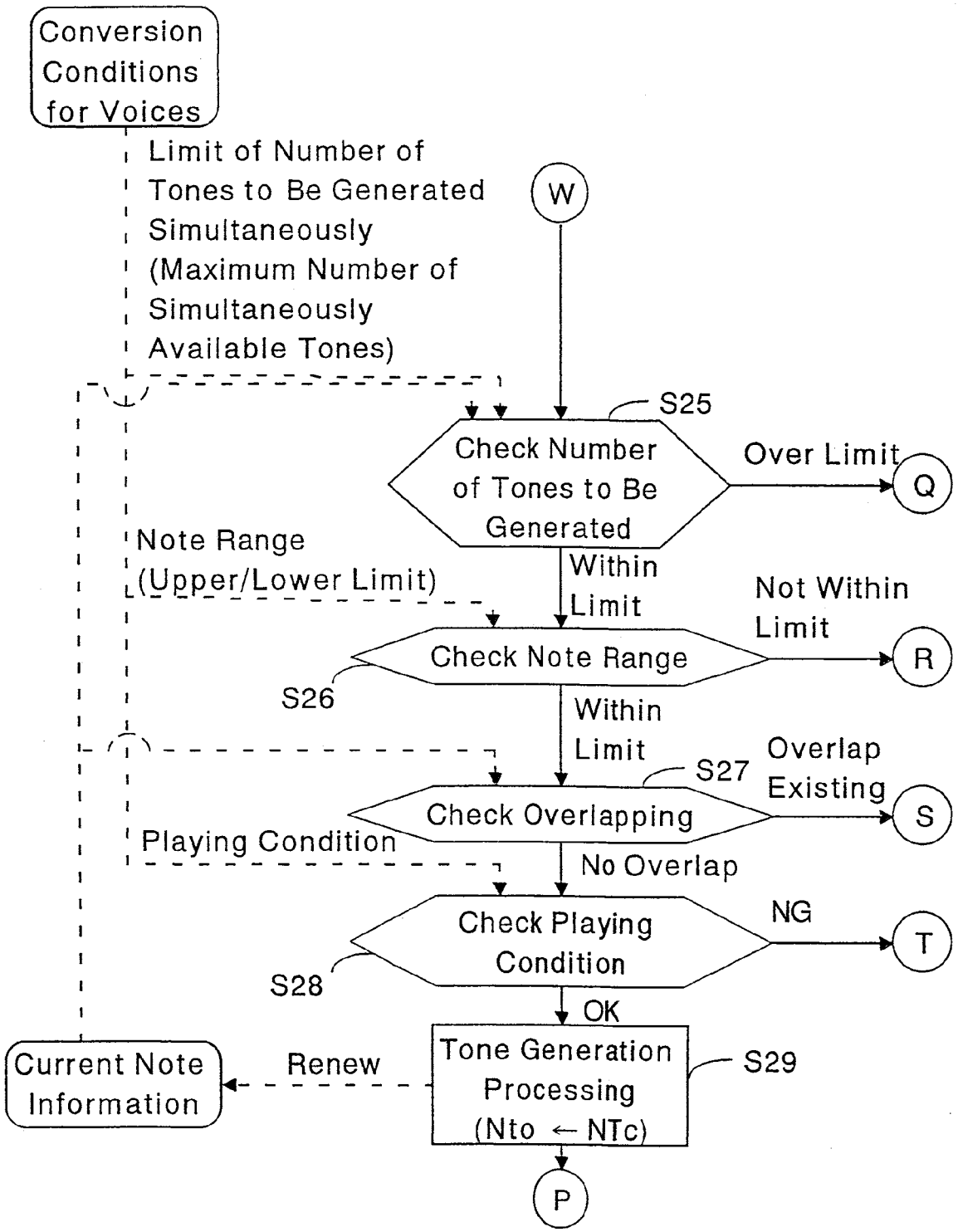

FIGS. 17*a*, 17*b* and 18, in combination, show a flow chart describing key-on processing #2 according to another embodiment of the present invention. In these Figures, rectangular blocks and hexagonal blocks tagged with symbols S21 through S35 represent process steps as indicated by the attached legends, respectively, and solid line arrows show flows between the steps. Corner-rounded rectangular blocks represent information (data contents) and broken line arrows indicate the use of the respective information.

As the user manipulates playing controls (i.e. depresses keys on the keyboard), a step S21 recognizes the key depression state. At this step S21, key-on information including current key-on note numbers NTi is inputted, and the number of simultaneously depressed keys is renewed accordingly (by the number of note numbers NTi, i.e. with a "+1" count at every new key-on and a "−1" count at every key-off). The step S21 also discriminates white/black key distinction according to the table selecting rules (above mentioned Ex. 1 through Ex. 3), and further measures every time intervals between every adjacent key-on events.

Next, a step S22 determines a conversion table to use for the note conversion. For example, corresponding to the voice kind VS as previously set in the system for the notes to be generated, the step S22 determines the normal and the tension note conversion table as designated by the table numbers of normal table NT and of tension table TT according to the conversion conditions for voices in FIG. 14. Then, which of the two determined tables is to be used is decided depending on the key depression state MC according to the conditions for the set table change over method.

Then, a step S23 sets the range search flags L (downward) and H (upward) both to be "TRUE," which will be used in a step S26 later, and a step S24 in turn converts the key-on note numbers NTi to output note numbers (i.e. converted note numbers) NTc with reference to the chord information and the number of simultaneously depressed keys using the determined table. A step S25 (FIG. 17*b*) then checks the number of tones to be generated, a step S26 checks the note range, a step S27 checks overlapping of notes, and a step S28 checks the playing conditions.

When all of the checks at the above described steps S25-S28 (FIG. 17*b*) are okayed, a step S29 conducts tone generation processing with respect to the converted note numbers NTc and outputs the same to the tone generator 38 as output note numbers NTo. When the tone generation processing is conducted, current note information is renewed, and then a step S30 (FIG. 18) renews the preceding key-depressed note number NTio by the current key-on note number NTi, and stands by (wait) for the next key manipulation (key-on event input).

In the step S25 for checking the number of tones to be generated, the maximum number of simultaneously available tones SM is obtained corresponding to the set voice kind from the conversion conditions for voices (FIG. 14), and whether the number of currently generated notes based on the current note information and the current key-on information is within the number limit of the simultaneously available notes as indicated by the maximum number of simultaneously available tones SM or not is examined. If the judgment at the step S25 is "within the limit," the process goes to the step S26 for the note range check, but if the number of currently generated notes exceeds the limit, the process moves forward to a step S31 (FIG. 18) to generate no tone (no further note). In case no tone is generated for the current key-on event, the process passes through the step S30 to renew the preceding key-depressed note NTo by the current key-on note number NTi before standing by (waiting) for the next key manipulation.

In the step S26 for checking the note range, the upper and the lower limit note number NH and NL are obtained corresponding to the set voice kind from the conversion conditions for voices (FIG. 14), and whether the converted note number NTc is within the upper note range defined by the note number NH or the lower note range defined by the note number NL or neither is examined. If the judgment at the step S26 is "the converted note number is below the lower limit note number NL," the downward flag "L" is set to be "FALSE" to prohibit the downward search, and if the judgment at the step S26 is "the converted note number is above the upper limit note number NH," the upward flag "H" is set to be "FALSE" to prohibit the upward search.

As long as the note range check judges the converted note number NTc is within either the upper or the lower note range, the process moves forward to the step S27 for the overlap check, but if neither, the process goes to a step S32 (FIG. 18) to check the limit for the converted note from the contents of the search flags H and L. If either of the search flags H and L is "TRUE," the step S32 judges a search in either direction is possible. In case the downward search flag L is "TRUE," a step S33 sets a downward search, while in case the upward search flag H is "TRUE," the step S33 sets an upward search. In either case, the process moves forward to a step S34 to add or subtract "1" to or from the note number NTi' for referring to the tables. The note number NTi' is NTi at the time of the key-on event. After the step S34, the step S24 (FIG. 17*a*) converts this NTi' using the note conversion table, and the reconverted note number NTc is subjected to the note range check at the step S26.

If the limit check at the step S32 (FIG. 18) reveals that both of the flags H and L are "FALSE" meaning the converted note is beyond the limit, the process proceeds to the step S31 to decide not to generate the note for the current key-on event. The preceding key-depressed note NTio is renewed by the current key-on note number NTi at the step S30, before standing by for a next coming key-on event.

The overlap check step S27 (FIG. 17*b*) checks whether the converted note number NTc overlaps with the current note information or not. In case the number of simultaneously generated tones is "1," the step S27 judges there is "no overlap." When the chord type is "Cancel," the step S27 may automatically judge there is "no overlap." When the judgment is made that there is no overlapping of notes, the process goes to the playing condition check S28, but when there is overlapping of notes, the process goes to a step S35 (FIG. 18) to search for a next candidate upward or downward depending on the direction in which the key depressions travel according to the user's playing.

The upward/downward search step S35 judges the travel direction of the current key from the preceding key by comparing the key-on note number NTi with the preceding key-depressed note NTio, and set the direction for search (upward or downward) according to the judged travel direction. The note number NTi' for referring to the tables is incremented or decremented by "1" (i.e. "+1" or "−1") at the step S34, and such an incremented or decremented note number NTi' is converted at the step S24 to a further converted candidate NTc, which is then subjected to the overlap check at the step S27.

The playing condition check step S28 (FIG. 17*b*) checks whether the converted note number NTc meets the playing conditions corresponding to the set voice kind in view of the table of conversion conditions for voices of FIG. 14. In this check, for example in the case of the guitar voice, the conditions include that the simultaneously generated notes should be assigned to individual strings on a one-to-one correspondence basis, and that all the frets to be pressed should reached by the left fingers without difficulty. Some voices (e.g. recorder) do not need the playing conditions check, and some voices may need the playing condition check about the reasonableness of the consecutive key-on times (i.e. the current note can be generated after the preceding key-on note NTio in view of time). If the playing condition check at the step S29 is okayed, the process moves forward to the step S29 for tone generation, but if not okayed (NG), the process goes to the step S31 (FIG. 18) not to generate the tone of the converted note candidate, and then the step S30 renews the preceding key-depressed note NTio by the current key-on note number NTi before standing by for a coming note input playing.

(Examples of Table Use)

Description will be herein below made with respect to the case in which the guitar voice is set among the conversion conditions for voices of FIG. 14, the normal conversion table TBa of FIG. 15 is used in connection with the white key manipulations, while the tension conversion table TBt1 is used in connection with the black keys of FIG. 16*b* as exemplified in (Ex. 1) above. The following example cases (1) and (2) will specifically explain how to use the note conversion tables in the above described key-on event processing #2.

(1) The case where the chord is C major, and the maximum number of simultaneously available notes is six (SM=6).

1) First, while there is no note being generated now, the user plays a first note "A5" (MIDI note number "81") on the keyboard 35.

1a) As the played input note "A5" (NTi) is a white-key note and a first note for generation, the normal conversion table TBa is referred to in the row of "Major" (at the step S22), the note "E" having the note employment factor of the priority order "1" is picked up, and the inputted "A5" is converted to the note "E5" (NTc). The note "E5" is immediately outputted as the output note number NTo and is generated as the current sounding note, and on the other hand the played key "A5" is stored as the preceding key-depressed note NTio (through the steps S24-S30).

2) While the note "E5" is being generated, the user plays a second note "F5" (MIDI note number "77").

2a) As the played input note "F5" (NTi) is a white-key note and now constitutes a two-simultaneous-tone generation state (less than the maximum number "6" of simultaneously available tones), the normal conversion table TBa is referred to in the row of "Major" at the step S22, the notes "E" and "G" having the note employment factors of the priority orders "1" and "G" are available, and the note "E" which is closer to "F" is picked up, and the inputted "F5" is converted to the note "E5" (NTc) as a candidate through the step S24.

2b) The note "E5" is already being generated, and the step S27 finds overlapping.

2c) Thus, the step S35 conducts an upward/downward search, determining which way to search. As the preceding key-depressed note NTio is "A5" and the current key-on note NTi is "F5," which constitutes a downward travel of key depressions ("F5"<"A5"), the key-on note number NTi is decremented by "1" to obtain a note number NTi' (="E5") for referring to table at the step S34 (FIG. 18).

2d) The step S24 (FIG. 17*a*) converts this note number NTi' to a candidate note "E5" by referring to the table TBa. But the step S27 (FIG. 17*b*) finds overlapping of notes, and then the step S35 (FIG. 18) determines a downward search again, and the step S34 decrement this note number NTi' by "1" to obtain a note number NTi' (="Eb5") for referring to table. The above mentioned processes through the steps S27, S35, S34 and S24 are repeated in a loop until the note number NTi' is decremented down to "B4."

2e) When the note number NTi' has become "B4" after the repeated loop processing, the table TBa gives out a note "G" as the closer note to "B4" at the step S24, and thus the candidate note number NTc "G4" passes through the steps S27 and S28 to come to the step S29 for the tone generation of NTo which is now "G4."

3) The first note key "A5" is now released, and keeping the second note key "F5" depressed (the generated note is "G4"), the user now depresses a third note key "B5" (MIDI note number "83").

3a) As the played input note "B5" (NTi) is also a white-key note and now constitutes a two-simultaneous-tone generation state (less than the maximum number "6" of simultaneously available tones), the normal conversion table TBa is referred to in the row of "Major" at the step S22, the notes "E" and "G" having the note employment factors of the priority orders "1" and "2" are available, and the note "G"

which is closer to "B" is picked up, and the inputted "B5" is converted to the note "G5" (NTc) as a candidate through the step S24.

3b) As the note which is being generated is "G4," the step S27 does not find overlapping. Thus, the candidate note "G5" is outputted as the output note NTo, and the tone of the note "G5" is produced at the step S29.

4) With the second and the third key "F5" and "B5" kept depressed, the user now depresses a fourth note key "C#5."

4a) As the played input note "C#5" is a black-key note, the tension table TBt1 is referred to in the row of "Major" at the step S22, the notes "D," "A" and "B" having the note employment factor "1" are available, and the note "D" which is closest to "C#" is picked up, and the inputted "C#5" is converted to the note "D5" (NTc) as a candidate through the step S24.

4b) As the notes which are currently being generated are "G4" and "G5," the note "D5" does not overlap with them, and therefore is generated as a sounding note through the steps S27-S29.

(2) The case where the chord is G major seventh, and the maximum number of simultaneously available notes is six (SM=6).

1) First, while there is no note being generated now, the user plays a first note "F3" (MIDI note number "53").

1a) As the played input note "F3" (NTi) is a white-key note, the normal note conversion table TBa (FIG. 15) is applied on the row of "M7" (major seventh) at the step S22. According to the row of "M7" in the table TBa, the note distance having the note employment factor of the priority order "1" is "11," which falls on "F#" in the case of the chord "G," and therefore the note "F#3" is picked up as the converted note NTc and is finally generated as a sounding tone, with the output note NTo substituted by NTc through the steps S24-S29.

2) With the first key "F3" kept depressed, the player depresses a second key "Eb3."

2a) As the depressed key "Eb3" is a black-key, the tension table TBt1 is referred to in the row of "M7" at the step S22. According to the "M7" row of the table TBt1, the note distances "2," "6" and "8" having the note employment factor "1" are available, which means the notes "A," "C#" and "Eb" are available in the case of the chord "G7," and thus the note "Eb3" which is closest to the depressed key "Eb" (NTi) is picked up, and the inputted "Eb3" is converted to the note "Eb3" (NTc) as a candidate through the step S24.

4b) The step S25 judges that the there are two generated notes "Eb3" and "F#3" which is within the maximum number of simultaneously available notes SM (="6"), and the step S27 judges there is no overlap of notes, and therefore the note "Eb3" is generated as a sounding note at the step S29, with the output note number NTo being renewed by the NTc.

(Modifications of Input Note Conversion Processing #2 and #3)

While preferred embodiments of the input note conversion processing #2 and #3 as conducted in the input note conversion system of the present invention have been described with reference to the associated drawings, various modifications will be possible without departing from the spirit of the present invention so that the present invention can be practiced in various forms.

Particularly with respect to the input note conversion processing #2, the basic notes and the non-basic notes may not necessarily be divided into chord constituent notes and other notes, but may be divided into scale notes and non-scale notes, or may be divided into a chord root and other notes. In the case where the basic notes are defined as chord constituent notes, other notes than the chord constituent notes may be the tension notes for the chord as in the embodiment, or may be potentially useful notes for ornaments (e.g. notes below the chord constituent notes by a minor second interval). Or may be the inputted note itself depending thereon.

The step S21 in the above described embodiment judges the key depression state to decide whether to convert to notes including non-basic notes and utilizes the distinction between the white keys and the black keys as mentioned at (Ex. 1) before. The judgment can be made by other ways to decide whether to use also the non-basic notes. For example, such a decision can be made depending on whether the number of simultaneously depressed keys exceeds a predetermined number (e.g. "8") as mentioned at (Ex. 2) before. Or further, by the distinction as mentioned at (Ex. 3) before, or depending on whether the velocity (touch strength) is less than a predetermined value (e.g. "30"), or whether the particular assigned key or control is manipulated, the conversion can be conducted also to non-basic notes. Needless to say, the case of (Ex. 2) can use the overall note conversion table TBs.

Although the above described embodiments used the tension note conversion table TBt1, TBt2, . . . to convert also to notes other than the chord constituent notes, such conversion notes may be determined by calculating some algorithms prepared in the system. For example, a conversion note (a note to which the inputted note is going to be converted) may be the closest non-chord constituent note to the inputted note, or may be the ninth note of the chord in the octave closest to the inputted note. A further alternative method may be that an inputted note is once converted to a chord constituent note (as a basic note) using the normal note conversion table, and thereafter modify the obtained chord constituent note to a tension note by calculation, which is the method of "a normal note conversion table+a calculation algorithm."

The note conversion tables may be combinable, modifiable, or may be of a type which can be edited. There may be prepared further kinds of conversion tables. For example, while the chord constituent notes are the basic notes, the conversion to non-chord constituent notes can be conducted by using different tables depending on the differences in key depressions by the user. While a same table is looked up in consideration of the number of simultaneously depressed keys, there may be prepared separate table to look up depending on the number of simultaneously depressed keys.

Although the above described key-on event processing #2 as an example in which the note data NTc after conversion us subject to various checks after the note number conversion step S24, the kinds of check are not limited thereto. The checks to decide not to generate (the step S31) the converted note are not limited to the step S25 of checking the number of tones to be generated (over limit), the step S28 of checking the playing conditions (NG) and the step S32 of checking the limits of the note ranges (beyond limits), but may include further checks. In case the chord type is designated as "cancel," the step S27 of checking the note overlap may be omitted so that the converted note will be generated anyway.

The number of chords to be applied to the note conversion is not limited. The chord data may be stored beforehand, or may be inputted in real time.

Particularly in the input note conversion processing #3, the contents of the table of conversion conditions for the voices (FIG. 14) may be user-writable.

While in the embodiment, the conversion table is determined with reference to the table of conversion conditions for voices (FIG. 14), separate conversion tables may be prepared for the respective voices. The tables for use in the step S25 for checking the number of tones to be generated simultaneously, the tables for use in the step S26 for checking the note ranges and the tables for use in the step S28 for checking the playing conditions may be likewise prepared separately with respective to individual voices. Further, necessary condition values may be obtained based on the properties of individual voices during the respective checking processing.

When referring to the note conversion tables TBa and TBs, the candidate converted notes are picked up in consideration of the number of simultaneously inputted notes (i.e. depressed keys) in the above explained embodiments, but separate conversion tables may be prepared individually for the different numbers of simultaneously inputted notes.

The step S25 of checking the number of tones to be simultaneously generated may be passed through (as within the limit) with respect to the voices which have nothing to do with the number of simultaneously generated notes.

In case the step S26 judges that the converted note NTc is not within the limit designated by the limit parameters NH or NL in the table of conversion conditions for the voices, the embodiment conducts the step S32 of limit check and forward (S33 and S34, or S31 and S30), but the processing may directly flow to the step S31 to generate no tone, or may shift the converted note NTc and then conduct the note range check step S26 again, or may involve other process steps.

As will be understood from the foregoing description, the present invention has many advantages including the following.

According to the assistive music playing system of the present invention, the player does not need to pay precise attention in playing (inputting) correct notes but to engage himself/herself in playing music rhythmically and emotionally according to his/her general feeling, thereby to present an acceptable music performance.

According to the input note conversion processing #1 in the input note conversion system of the present invention, the inputted notes according to the user's playing are converted to the notes which will fit the chord at the time of the note input using the conversion tables adapted for different chords, and further the note conversion is controlled so that a plurality of converted notes for simultaneous generation shall not be the same or very close notes depending on the note sub-ranges or on the playing conditions, thereby preventing the generation of overlapping notes, and therefore a natural acoustic feeling will be maintained.

According to the input note conversion processing #2 in the input note conversion system of the present invention, the inputted notes according to the user's playing are converted to the notes which will fit the chord at the time of the note input, and the note conversion is controlled so that the converted note may be basic notes (e.g. chord constituent notes or scale notes) or may be non-basic notes (e.g. tension notes or ornaments) based on the note input state such as the key depression state, thereby permitting the conversion to the notes other than basic notes depending on the note input state, and therefore the player can enjoy a music performance with full of variety including non-basic notes according to the player's desire.

According to the input note conversion processing #3 in the input note conversion system of the present invention, the inputted notes according to the user's playing are converted to the notes which will fit the chord at the time of the note input, in which the note conversion tables are selectively used according to the voices designated by the voice information, and the converted notes are further controlled to fit the voice according to the note conversion conditions corresponding to the designated voice, and therefore different note conversions are possible in connection with different voices, so that a realistic performance with peculiar features on an actual instrument (voice) will be presented without the user paying particular attention.

While several forms of the invention have been shown and described, other forms will be apparent to those skilled in the art without departing from the spirit of the invention. Therefore, it will be understood that the embodiments shown in the drawings and described above are merely for illustrative purposes, and are not intended to limit the scope of the invention, which is defined by the appended claims.

What is claimed is:

1. An assistive music playing apparatus for generating polyphonic notes, where respective turn-on periods thereof overlap, the apparatus comprising:

a chord progression pattern providing device that provides a chord progression pattern representing a series of chords;

a note input device that inputs notes constituting music playing along with said chord progression, said input notes potentially including unacceptable notes to be subjected to note correction; and a note conversion device, including a note conversion table containing conversion parameters for converting notes, which note conversion device converts said input notes, with reference to a current chord in said chord progression at the time of said input notes, to converted polyphonic notes based on the conversion parameters set forth in the note conversion table so that the pitch of each of the converted polyphonic notes is different from each other while the respective turn-on periods thereof are overlapping.

2. The assistive music playing apparatus as claimed in claim 1, wherein said note conversion device has different conversion algorithms for different note sub-ranges.

3. The assistive music playing apparatus as claimed in claim 2, further comprising an additional note providing device that provides an additional note to the converted polyphonic notes based on said converted polyphonic notes.

4. The assistive music playing apparatus as claimed in claim 1, wherein the polyphonic notes include substantially simultaneously input notes, where substantially the respective entire turn-on periods thereof overlap, wherein said note conversion device converts said input notes to the converted polyphonic notes with reference to the current chord in said chord progression at the time of said input notes according to the number of substantially simultaneously input notes, a note distance between the highest note and the lowest note in said substantially simultaneously input notes, and the note degree of said highest note from the root of said current chord in said chord progression, so that the pitch of each of the converted polyphonic notes is different from each other while the respective turn-on periods thereof are overlapping.

5. The assistive music playing apparatus as claimed in claim 4, further comprising an additional note providing device that provides an additional note to the converted polyphonic notes based on said converted polyphonic notes.

6. The assistive music playing apparatus as claimed in claim 1, further comprising an additional note providing device that provides an additional note to the converted polyphonic notes based on said converted polyphonic notes.

7. The assistive music playing apparatus as claimed in claim 1, wherein the note conversion device comprises:

a first note conversion device that includes the note conversion table, wherein the first note conversion device converts said input notes to first converted polyphonic notes with reference to the current chord in said chord progression at the time of said input notes; and a second note conversion device that converts, when a plurality of said first converted polyphonic notes become the same notes, one of said same notes to another note based on the conversion parameters set forth in the note conversion table so that the pitch of each of the converted polyphonic notes is different from each other while the respective turn-on periods thereof are overlapping.

8. The assistive music playing apparatus as claimed in claim 7, further comprising an additional note providing device that provides an additional note to the converted polyphonic notes based on said converted polyphonic notes.

9. The assistive music playing device as claimed in claim 1, further including a note conversion control device that takes one of the converted polyphonic notes as an output candidate, detects music playing conditions from the input notes, and controls the note conversion device in different manner depending on the detected playing condition so that the pitch of one of the converted polyphonic notes is different from the pitch of another note currently being generated based on the conversion parameters set forth in the note conversion table so that the pitch of each of the converted polyphonic notes is different from each other while the respective turn-on periods thereof are overlapping.

10. The assistive music playing device as claimed in claim 1, further including a note conversion control device that compares the note pitches of the note that is currently subjected to note conversion and the preceding input note as to which is higher when there is another note being generated, and controls the note conversion device according to the comparison result so that the pitch of the converted note is different from the pitch of another note currently being generated based on the conversion parameters set forth in the note conversion table so that the pitch of each of the converted polyphonic notes is different from each other while the respective turn-on periods thereof are overlapping.

11. The assistive music playing device as claimed in claim 1, further including:

a voice information acquiring device that acquires voice information from a voice information providing device; and a plurality of note conversion tables containing note employment factors that decide available converted notes corresponding to the respective chord types, wherein the note conversion device converts notes based on the note conversion table that is selected from among said plurality of note conversion tables according to the voice information, so that the pitch of each of the converted polyphonic notes is different from each other while the respective turn-on periods thereof are overlapping.

12. The assistive music playing device as claimed in claim 1, further including:

a voice information acquiring device that acquires voice information from a voice information providing device; and a voice condition storing device that stores note conversion conditions corresponding to the respective voices, wherein the note conversion device converts polyphonic notes based on the note conversion conditions corresponding to the voice as designated by the voice information so that the pitch of each of the converted polyphonic notes is different from each other while the respective turn-on periods thereof are overlapping.

13. A computer-readable medium storing a computer program for an assistive music playing apparatus for generating polyphonic notes, where respective turn-on periods thereof overlap, the program including instructions for:

providing a chord progression pattern representing a series of chords;

inputting notes constituting music playing along with said chord progression, said input notes potentially including unacceptable notes to be subjected to note correction; and converting said input notes to converted polyphonic notes with reference to a current chord in said chord progression at the time of said input notes and a note conversion table containing conversion parameters for converting notes, so that the pitch of each of the converted polyphonic notes is different from each other while the respective turn-on periods thereof are overlapping.

14. The computer-readable medium as claimed in claim 13, wherein the converting instruction applies different conversion algorithms for different note sub-ranges.

15. The computer-readable medium as claimed in claim 14, further including the instruction for providing an additional note to the converted polyphonic notes based on said converted notes.

16. The computer-readable medium as claimed in claim 13, wherein the polyphonic notes include substantially simultaneously input notes, where substantially the respective entire turn-on periods thereof overlap, wherein the converting instruction converts said input notes to the converted polyphonic notes with reference to the current chord in said chord progression at the time of said input notes according to the number of substantially simultaneously input notes, a note distance between the highest note and the lowest note in said substantially simultaneously input notes, and the note degree of said highest note from the root of said current chord in said chord progression, so that the pitch of each of the converted polyphonic notes is different from each other while the respective turn-on periods thereof are overlapping.

17. The computer-readable medium as claimed in claim 16, further including the instruction for providing an additional note to the converted polyphonic notes based on said converted polyphonic notes.

18. The computer-readable medium as claimed in claim 13, further including the instruction for providing an additional note to the converted polyphonic notes based on said converted polyphonic notes.

19. The computer-readable medium as claimed in claim 13, wherein the converting instruction comprises:

converting said input notes to first converted polyphonic notes with reference to the current chord in said chord progression at the time of said input notes and the note conversion table containing conversion parameters for converting notes; and converting, when a plurality of said first converted polyphonic notes become the same notes, one of said same notes to another note based on the conversion parameters set forth in the note conversion table so that the pitch of each of the converted polyphonic notes is different from each other while the respective turn-on periods thereof are overlapping.

20. The computer-readable medium as claimed in claim 19, further including the instruction for providing an additional note to the converted polyphonic notes based on said converted polyphonic notes.

21. The computer-readable medium as claimed in claim 13, wherein the computer program further includes the instructions for controlling the conversion of polyphonic notes by taking one of the converted polyphonic notes as an output candidate, detecting music playing conditions from the input notes, and converting another of the polyphonic notes in different manner depending on the detected playing condition so that the pitch of the another note being currently generated based on the conversion parameters set forth in the note conversion table is different from the pitch of the one note so that the pitch of each of the converted polyphonic notes is different from each other while the respective turn-on periods thereof are overlapping.

22. The computer-readable medium as claimed in claim 13, wherein the computer program further includes the instructions for comparing the note pitches of one of the polyphonic notes currently being converted and the preceding input note as to which is higher when there is another note being generated, and controlling the conversion according to the comparison result so that the pitch of the note being currently converted based on the conversion parameters set forth in the note conversion table is different from the pitch of other notes of the converted polyphonic notes so that the pitch of each of the converted polyphonic notes is different from each other while the respective turn-on periods thereof are overlapping.

23. The computer-readable medium as claimed in claim 13, wherein the program further includes the instructions for:

acquiring voice information from a voice information providing device; and converting polyphonic notes based on the note employment factors set forth in the note conversion table selected from among said plurality of note conversion tables according to the voice information, so that the pitch of each of the converted polyphonic notes is different from each other while the respective turn-on periods thereof are overlapping.

24. The computer-readable medium as claimed in claim 13, wherein the program further includes the instruction for:

acquiring voice information from a voice information providing device; and converting polyphonic notes based on said note conversion conditions corresponding to the voice as designated by the voice information, so that the pitch of each of the converted polyphonic notes is different from each other, while the respective turn-on periods thereof are overlapping.

* * * * *